US011279449B2

(12) United States Patent
Eikens et al.

(10) Patent No.: US 11,279,449 B2
(45) Date of Patent: Mar. 22, 2022

(54) PROCESS SYSTEM AND A FLUID TRANSFER SYSTEM COMPRISING SUCH A PROCESS SYSTEM

(71) Applicant: Connect LNG AS, Oslo (NO)

(72) Inventors: Magnus Eikens, Oslo (NO); John Randolph Holland, Schwanewede (DE); Stian Tunestveit Magnusson, Oslo (NO); Bjornar Danielsen, Asker (NO)

(73) Assignee: Connect LNG AS, Oslo (NO)

( * ) Notice: Subject to any disclaimer, the term of this patent is extended or adjusted under 35 U.S.C. 154(b) by 0 days.

(21) Appl. No.: 16/643,597

(22) PCT Filed: Sep. 6, 2018

(86) PCT No.: PCT/EP2018/074000
§ 371 (c)(1),
(2) Date: Mar. 2, 2020

(87) PCT Pub. No.: WO2019/048543
PCT Pub. Date: Mar. 14, 2019

(65) Prior Publication Data

US 2020/0189692 A1 Jun. 18, 2020

(30) Foreign Application Priority Data

Sep. 6, 2017 (NO) ..... 20171442

(51) Int. Cl.
*B63B 27/34* (2006.01)
*B63B 27/25* (2006.01)
(Continued)

(52) U.S. Cl.
CPC ..... *B63B 27/25* (2013.01); *B63B 27/32* (2013.01); *B63B 27/34* (2013.01); *B67D 9/00* (2013.01);
(Continued)

(58) Field of Classification Search
CPC ..... B63B 27/25; B63B 27/32; B63B 27/34; B63B 27/24; B67D 9/00; F17C 9/00;
(Continued)

(56) References Cited

U.S. PATENT DOCUMENTS 2,922,446 A 1/1960 Sheiry
5,125,691 A 6/1992 Bogdan
(Continued)

FOREIGN PATENT DOCUMENTS

CN 1289298 3/2001
CN 1384792 12/2002
(Continued)

OTHER PUBLICATIONS

CN Search report in 2018800577937.
CN Office Action dated Jun. 21, 2021 in 2018800577937.
Search Report dated Oct. 6, 2021 from India Patent Office.

*Primary Examiner* — Jason K Niesz
(74) *Attorney, Agent, or Firm* — Christian D. Abel

(57) ABSTRACT

A process system (15) for transfer of a fluid between a floating or non-floating facility (11) and a receiving structure (21) via a support unit (12) is disclosed, where the process system (15) comprises: —a first pipe element (58) for transport of fluid on the support unit (12), —a second pipe element (68) for transport of fluid on the support unit (12), —a first cross over pipe (22) that is fluidly connected to the first pipe element (58) and the second pipe element (68), —a second cross over pipe (26) that is fluidly connected to the first pipe element (58) and the second pipe element (68), —a first valve device (30) arranged in the first cross over pipe (22), —a second valve device (31) arranged in the second cross over pipe (26) —a first cargo valve device (39) that is provided in the first pipe element (58), —a second cargo valve device (40) that is provided in the second pipe element
(Continued)

(68). A fluid transfer system (10) comprising such a process system (15) is also disclosed.

13 Claims, 10 Drawing Sheets

(51) Int. Cl.
*F17C 9/00* (2006.01)
*B63B 27/32* (2006.01)
*B67D 9/00* (2010.01)

(52) U.S. Cl.
CPC ..... *F17C 9/00* (2013.01); *F17C 2205/0323* (2013.01); *F17C 2223/0161* (2013.01); *F17C 2270/0118* (2013.01)

(58) Field of Classification Search
CPC ..... F17C 2205/0323; F17C 2205/0338; F17C 2223/0161; F17C 2270/0118
See application file for complete search history.

(56) References Cited

U.S. PATENT DOCUMENTS

| | | | | |
|---|---|---|---|---|
| 2003/0017299 | A1 | 1/2003 | de Baan | |
| 2003/0172991 | A1* | 9/2003 | de Baan | B63B 27/24 141/382 |
| 2015/0329184 | A1* | 11/2015 | Deletre | F16L 3/015 248/81 |

FOREIGN PATENT DOCUMENTS

| | | | |
|---|---|---|---|
| CN | 1420841 | | 5/2003 |
| CN | 106061832 | | 9/2003 |
| CN | 101500887 | | 8/2009 |
| CN | 103328878 | | 9/2013 |
| CN | 106715997 | | 5/2017 |
| EP | 1899219 | | 2/2012 |
| EP | 29563846 | | 10/2017 |
| JP | 62-123000 | | 6/1987 |
| KR | 100868856 | B1 | 11/2008 |
| KR | 20120003894 | | 6/2012 |
| WO | 2007/032842 | | 3/2007 |
| WO | 2016/052374 | | 7/2016 |

* cited by examiner

PROCESS SYSTEM AND A FLUID TRANSFER SYSTEM COMPRISING SUCH A PROCESS SYSTEM

The present invention relates generally to a process system and a fluid transfer system for transfer of a fluid between a floating or non-floating facility and a receiving structure via a support unit.

For floating units it is now common practice to load or discharge fluids such as liquids, liquefied gases and fluidized amorphous solids via flexible pipes, hoses or subsea risers and subsea pipes between ships, offshore units and/or onshore terminals. Normally the floating flexible pipe, hose or riser is lifted from the sea and connected to a fixed manifold or pipe on the floating unit to enable transfer of fluid. When the transfer operation is completed the floating flexible pipe, hose or riser is disconnected from the manifold or pipe of the floating unit and returned to the sea. Transfer using aerial hoses is carried out in a similar manner. The difficulty of handling and lifting the flexible pipe, hose or riser up to the fixed manifold or pipe on the floating unit is proportional to the forces and moments acting on the flexible pipe, hose or riser.

Draining and purging of the floating flexible pipe, hose or riser cannot be achieved without the floating or non-floating facility being present. Furthermore, the floating or non-floating facility must be connected to the floating flexible pipe, hose or riser, unless a parallel transfer line is provided and the transfer lines are connected by a subsea valve and a remote actuator. Such remote subsea actuators are expensive and hard to maintain.

It is usual for the floating flexible pipe, hose or riser to be relatively short and the transfer operation must be conducted in acceptable environmental conditions, for example low sea state, low water currents and no drift ice present.

There is a growing need for such transfer operations to be carried out over longer distances and in more severe environmental conditions and without modifications on the floating unit. The floating flexible pipes, hoses or risers may need to remain connected to their manifolds or pipes for an extended period of time. The fixed manifolds or pipes on ships, offshore units and marine terminals are only designed to handle forces and bending moments which may be encountered during transfer operations employing conventional transfer methods, for example loading arms, aerial hoses and short flexible pipes, hoses or risers.

The forces and bending moments of longer floating flexible pipes, hoses or risers which are subject to high sea states, currents, winds or ice will greatly exceed that of current manifold or pipe end design standards. Strengthening the manifold or pipe to accommodate such forces is technically and operationally challenging and costly.

An objective of the present invention has therefor been to develop a system for transfer of a fluid through a body of water that provides a cheaper, more versatile transfer solution of the fluid with a shorter lead time.

It has further been an objective of the present invention to develop a process system comprising one or more pipes that can be arranged on a support unit such that draining and purging can be enabled without the presence of a floating or non-floating unit.

It has also been an objective of the present invention to develop a system for transfer of a fluid across a body of water that helps to alleviate the problems caused by forces and bending moments on longer transfer pipes or hoses in water caused by high sea states, currents, winds, ice conditions etc.

It has also been an objective of the present invention to develop a process system, comprising one or more pipes, that is capable of handling forces and bending moments from a transfer pipe that is connected to the process system and is arranged in a body of water.

It has further been an objective of the present invention to develop a tie-in system for a fluid pipe or a hose transferring fluid through a body of water where the tie-in system is capable of handling forces and bending moments on the fluid pipe or hose due to high sea states, water currents, winds, difficult ice conditions etc.

These objectives are achieved with a process system as defined in claim 1 and a fluid transfer system as defined in claim 10. Further embodiments of the process system and the fluid transfer system are defined in dependent claims 2-9 and dependent claims 11-16 respectively.

Hence, there is provided a process system for transfer of a fluid between a floating or non-floating facility and a receiving structure via a support unit, wherein the process system comprises:

- a first pipe element for transport of fluid on the support unit,
- a second pipe element for transport of fluid on the support unit,
- a first cross over pipe that is fluidly connected to the first pipe element and the second pipe element,
- a second cross over pipe that is fluidly connected to the first pipe element and the second pipe element,
- a first valve device arranged in the first cross over pipe,
- a second valve device arranged in the second cross over pipe
- a first cargo valve device that is provided in the first pipe element, and
- a second cargo valve device that is provided in the second pipe element.

The first cargo valve device is preferably arranged in the first pipe element between the first cross pipe connection and the third cross pipe connection. The second cargo valve device is preferably arranged in the second pipe element between the second cross pipe connection and the fourth cross pipe connection.

The process system is preferably adapted to be movably supported on the support unit. To arrange the process system so that it is movably supported on the support unit will allow forces acting on the process system from floating pipes and/or hoses and aerial pipes and/or hoses that are connected to the process system to be handled without causing damage to the process system. To arrange the process system so that it is movably supported on the support unit will also allow tension caused by thermal contractions and expansions to be handled so that the process system is not damaged.

The process system is preferably adapted to be movably supported in a longitudinal direction of the process system and/or a transverse direction of the process system where the transverse direction is substantially perpendicular to the longitudinal direction. The longitudinal direction is preferably the same direction as the longitudinal direction of the first and second pipe elements of the process system at the point where the first and second pipe elements are connected to a transfer pipe.

Preferably, the first pipe element of the process system is adapted to be connected to a first transfer pipe and the second pipe element of the process system is adapted to be connected to a second transfer pipe.

The first transfer pipe and the second transfer pipe are preferably fluidly connected to a receiving structure.

The term "receiving structure" used herein should be understood such that the receiving structure can be a structure receiving fluid that is transported from the support unit through the transport pipe or a structure that feeds or supplies fluid to the transfer pipe which is subsequently transported towards the support unit. The receiving structure may therefore be a floating or non-floating offshore or onshore terminal or any other type of floating or non-floating structure that is designed to receive fluid that is transported through the transport pipe from the support unit to the receiving structure. The receiving structure may also be a floating or non-floating offshore or onshore terminal or any other type of floating or non-floating structure that is designed to supply fluid for transport through the transport pipe from the receiving structure to the support unit.

The process system may also comprise at least one aerial hose that is fluidly connected to the first pipe element and the second pipe element of the process system, where the at least one aerial hose is adapted to be connected to a floating or non-floating facility. If the fluid transported through the at least one transfer pipe is a cryogenic fluid, for example LNG, the floating or non-floating facility may for example be an LNG-carrier or an LNG-terminal.

The process system may comprise a single aerial hose that is fluidly connected to both the first pipe element and the second pipe element. Preferably, the process system comprises a first aerial hose that is connected to the first pipe element and adapted to be connected to the floating facility, and a second aerial hose that is connected to the second pipe element and adapted to be connected to the floating facility.

Alternatively, the process system may also comprise a plurality of aerial hoses that are connected to the first pipe element and/or the second pipe element where the plurality of aerial hoses are adapted to be connected to the floating or non-floating facility.

Preferably, the at least one first aerial hose and/or the at least one second aerial hose is/are adapted to be disconnectably connected to the floating or non-floating facility.

The at least one aerial hose is preferably fluidly connected to the first pipe element and/or the second pipe element with at least one break away coupling. Preferably, the first pipe element and/or the second pipe element is provided with a break away coupling to which the at least one aerial hose is fluidly connected. The term "fluidly connected" means that two pipes and/or hoses are connected to each other such that fluid can be flowed from one of the pipes/hoses to the other of the pipes/hoses.

Preferably the first aerial hose is connected to the first pipe element with a first break away coupling and the second aerial hose is connected to the second pipe element with a second break away coupling. The first and second break away couplings will allow the disconnection of the first aerial hose and second aerial hose from the process system in case of emergency.

Preferably a break away coupling is provided in the process system for each aerial hose that the process system is adapted to be connected to such that each aerial hose is allowed to be disconnected from the process system independently of each other in case of an emergency situation.

The process system is preferably also provided with a first emergency shut down valve that is provided in the first pipe element and a second emergency shut down valve that is provided in the second pipe element. The first emergency shut down valve may be provided in the first pipe element between a first cross pipe connection where the first cross over pipe is fluidly connected to the first pipe element and a third cross pipe connection where the second cross over pipe is fluidly connected to the first pipe element, and the second emergency shut down valve may be provided in the second pipe element between a second cross pipe connection where the first cross over pipe is fluidly connected to the second pipe element and a fourth cross pipe connection where the second cross over pipe is fluidly connected to the second pipe element. Alternatively, for example if bulk material is being transported, the process system may not be provided with any emergency shut down valve devices. There may further be arranged a plurality of emergency valves in the first and second pipe elements, depending on the type of operation and required redundancy.

The process system preferably comprises a vent mast that may be fluidly connected to the first pipe element on either side of the first cargo valve device or on either side of the first emergency shut down valve, and to the second pipe element on either side of the second cargo valve device or on either side of the second emergency shut down valve. Preferably the vent mast is fluidly connected to the first pipe element on either side of the one of the first cargo valve device and the first a first emergency shut down valve that is arranged closest to the floating or non-floating facility. Preferably the vent mast is also fluidly connected to the second pipe element on either side of the one of the second cargo valve device and the second emergency shut down valve that is arranged closest to the floating or non-floating facility. Generally, the vent mast is connected to the first pipe element and the second pipe element and any further pipe element of the process system such that any fluid that is trapped in the process system when the cargo valve devices and/or the emergency shut down and/or the breakaway valves are closed, may be vented through the vent mast.

There is also provided a process system for transfer of a fluid between a floating or non-floating facility and a receiving structure, where the fluid transfer system comprises a support unit and a process system as described above, where the process system is movably supported on the support unit.

As mentioned above, the term "receiving structure" used herein should be understood such that the receiving structure can be a structure receiving fluid that is transported from the support unit through the transport pipe or a structure that feeds or supplies fluid to the transfer pipe which is subsequently transported towards the support unit. The receiving structure may therefore be a floating or non-floating offshore or onshore terminal or any other type of floating or non-floating structure that is designed to receive fluid that is transported through the transport pipe from the support unit to the receiving structure. The receiving structure may also be a floating or non-floating offshore or onshore terminal or any other type of floating or non-floating structure that is designed to supply fluid for transport through the transport pipe from the receiving structure to the support unit.

The fluid transfer system preferably comprises at least one process system support device that is securely mounted to the support unit and/or the process system, where the at least one process system support device is adapted to allow the process system to move relative to the support unit in response to external forces acting on the process system. The at least one process system support device may, for example, comprise a slide bearing, but any other suitable device may also be used where the process system is supported so that it may move relative to the support unit.

The fluid transfer system preferably comprises at least one limit stop that limits the movements of the at least one pipe element of the process system relative to the support unit in at least one direction. For example, the at least one process system support device may comprise at least one limit stop that limits the movements of the at least one pipe element of the process system relative to the support unit in at least one direction. The limit stops are present to ensure that the manifolds of the process system fulfill requirements for strength and also to ensure that the process system stays in place and is not dragged in to the sea if the tie-in device fails. The at least one limit stop is preferably adapted to limit the movements of the first and second pipe elements of the process system relative to the support unit in a longitudinal direction. The longitudinal direction is preferably the same direction as the longitudinal direction of the first and second pipe elements of the process system at the point where the first and second pipe elements are connected to a transfer pipe. Therefore, the at least one process system support device preferably comprises at least one limit stop that limits the movement of the first and second pipe elements of the process system relative to the support unit in the longitudinal direction of the first and second pipe elements. The at least one limit stop may also be adapted to limit the movements of the first and second pipe elements of the process system relative to the support unit in a transverse direction where the transverse direction is substantially perpendicular to the longitudinal direction.

Preferably, the at least one limit stop that limits the movement of the first and second pipe elements of the process system relative to the support unit in the longitudinal direction of the at least one pipe element is provided on the process system support device that is closest to the transfer pipe.

Furthermore, the limit stop in the longitudinal direction of the at least one pipe element is preferably provided with slack if that is considered necessary. That may be the case because if the limit stop is rigid and the tie-in devices are strained more than the first and second pipe elements, between the limit stop and the flange devices of the first and second pipe elements to which the first and second transfer pipes are connected, due to forces from the first and second transfer pipes, large forces would be transferred to the first and second pipe elements.

The at least one process system support device may further comprise at least one limit stop that limits the movement of the first and second pipe elements of the process system relative to the support unit in the transverse direction of the first and second pipe elements. The fluid transfer system may be provided with a plurality of limit stops that limit the movement of the first and second pipe elements of the process system relative to the support unit in the transverse direction of the first and second pipe elements.

The first pipe element of the process system is preferably connected to a first transfer pipe and the second pipe element of the process system is preferably connected to a second transfer pipe. The first pipe element of the process system may be connected to the first transfer pipe with a first tie-in system and the second pipe element of the process system is preferably connected to a second transfer pipe with a second tie-in system. The first transfer pipe and the second transfer pipe are preferably fluidly connected to the receiving structure. A fluid may thereby be transferred from the support unit to the receiving structure or from the receiving structure to the support unit through the first and second transfer pipes. It should also be mentioned that one or more tie-in systems may be installed on the support unit and/or the receiving unit as required in each case.

Preferably, the fluid transfer system further comprises:

- a first spool piece that in one end is connected to the first transfer pipe and in the other end is attached to the first pipe element,
- a second spool piece that in one end is connected to the second transfer pipe and in the other end is attached to the second pipe element,
- a first chute device that is attached to the support unit, the first transfer pipe being accommodated in the first chute device such that the first chute device supports the first transfer pipe and takes up vertical and transverse forces acting on the first transfer pipe,
- a second chute device that is securely attached to the support unit, the second transfer pipe being accommodated in the second chute device such that the second chute device supports the second transfer pipe and takes up vertical and transverse forces acting on the second transfer pipe,
- a first tie-in device that is connected to a first spool piece tie-in member that is arranged on the first spool piece and to a first tie-in member arranged on a tie-in support that is securely attached to the support unit and a second tie-in device that is connected to a second spool piece tie-in member that is arranged on the first spool piece and to a second tie-in member arranged on the tie-in device, whereby the tension loads are transferred from the first transfer pipe to the support unit,
- a first tie-in device that is connected to a first spool piece tie-in member that is arranged on the second spool piece and to a first tie-in member arranged on a tie-in support that is securely attached to the support unit and a second tie-in device that is connected to a second spool piece tie-in member that is arranged on the second spool piece and to a second tie-in member arranged on the tie-in device, whereby the tension loads are transferred from the second transfer pipe to the support unit.

The first chute device is preferably also designed to limit bending of the first transfer pipe so that the mechanical limitations of the first transfer pipe is not exceeded and damage to the first transfer pipe is avoided. Similarly, the second chute device is preferably also designed to limit bending of the second transfer pipe so that the mechanical limitations of the second transfer pipe is not exceeded and damage to the second transfer pipe is avoided.

The transfer pipe is preferably a flexible pipe or hose that is capable of being bent to a certain degree. The transfer pipe may be a floating transfer pipe or a submerged transfer pipe or a combination of floating and submerged. The pipe element, to which the transfer pipe is attached on the support unit, is preferably a rigid pipe element. As with other flexible pipes or hoses, the transfer pipe has a maximum bending radius beyond which the transfer pipe should not be bent to avoid damage. Suitable pipes or hoses that can be used for transfer of various types of fluids and/or multiphase fluids (which may comprise solid particles and substances such as for example sand, gravel and so on) and/or bulk material such as a powder material are well known in the art and will not be further described herein.

The support unit is preferably a floating unit, a non-floating gravity based unit, a non-floating non-gravity based structure like a truss work or pillars with a deck mounted on top. The support unit is further preferably a floating or non-floating structure to which a transfer pipe or hose that is arranged in water can be connected to. The support unit may be a structure that the fluid is transported via, i.e. the support unit acts as a transfer unit for the fluid which is transported from a supply structure to a receiving structure via the support/transfer structure. Alternatively the support unit can be either a supply structure or a receiving structure for the fluid that is transport through the transfer pipe, i.e. the fluid is not transported via the support unit.

The first and second transfer pipes are thereby connected to the support unit with a tie-in system so that transfer of a fluid through the first and second transfer pipes can take place via the support unit, for example transfer of a cryogenic liquid like LNG between the floating or non-floating facility like for example an LNG-carrier and a receiving structure comprising storage facilities, preferably located onshore, but may also be located partly or completely offshore. The receiving structure receives LNG from the transfer structure before it is transported further or receives LNG before it is transported to the transfer structure.

The tie-in system is designed to support the transfer pipes in form of a fluid pipe, floating flexible pipe, hoses, risers and other similar objects that is connected to a manifold of a process system on the support unit, and a fluid transfer system for transfer of fluid through the transfer pipe via the transfer structure. The support unit may be a floating unit such as a semi-submersible platform, a non-floating unit, a ship, or other types offshore or onshore units, structures or terminals. The process system arranged on the support unit comprises at least two pipe elements, a first pipe element and a second pipe element, that are physically and fluidly connected to each other as described above. The process system further comprises valve devices of various types to control the flow of fluid through the process system.

The bending moments and shear forces which may be imposed on the manifold (the flange connection or connections connecting the pipe element or elements to transfer pipe or pipes) are substantially taken up by the chute devices formed so as to allow the seaward end of the transfer pipes arranged in the chute devices limited angular displacement in the transverse and vertical directions. The angular displacement could be for example +/−30 degrees in the transverse direction of the transfer pipe and 30 degrees below the pipeline axis in the vertical direction. It should, however, be noted that the angular displacement can be more or less than the +/−30 degrees indicated above.

The chute devices are preferably funnel shaped and narrow at the manifold end, and wide where the transfer pipes enters the sea. The sides and bottom of the chute devices take up the transverse and vertical forces of the transfer pipes and transfer them to the support unit, via the chute support.

At the manifold of the process system, one or more brackets may be fixed to the structure of the support unit where the bracket/brackets is/are connected to a spool piece that is fixed to the end of the transfer pipe via a tie-in device. The tie-in devices are preferably a mechanical holding device such as for example a turnbuckle, a rigging screw, a hydraulic tensioner or a fixed rod of a predetermined length. The spool pieces are designed to allow them to be fitted to an end of respective transfer pipes so that the transfer pipes can be attached and fixed to the brackets. As the chute devices take most of the transverse and vertical forces of the transfer pipes, the brackets take the axial forces of the transfer pipes. As mentioned above, the process system on the support unit is designed to allow a limited amount of movement of the process system relative to the support unit, for example +/−10 mm of axial movement in the longitudinal direction in order to avoid the transfer of axial forces from the transfer pipes to the process system. Such movement allows for inexact axial alignment of the transfer pipes and/or difference in strain between the mechanical holding device and the manifold of the process system and/or thermal expansion or contraction of the process system, i.e. the pipes that the process system is comprised of. As mentioned, the process system may also be designed to allow movement in a transverse direction.

The spool pieces may be adapted to be disconnectably connected to the first and second pipe elements that are arranged on the support unit. For example, each spool piece may be provided with a spool piece flange that is attached to a corresponding flange element on the first and second pipe elements, for example with a number of bolts.

The spool pieces may be separate pieces that are attached to the first and second transfer pipes. The spool pieces may be attached to the first and second transfer pipes by bolts, screws or any other suitable fastening means. Alternatively, the spool pieces may be an integral part of the first and second transfer pipes. The spool pieces may be securely attached to the first and second transfer pipes by welding, adhesive, a combination of the two or any other suitable method for attaching the spool pieces to the first and second transfer pipes.

The spool pieces may each comprise a spool piece flange for attachment to a flange element on the first and second pipe elements on the support unit. The spool piece flanges may be fastened to the flange elements on the first and second pipe elements with bolts, screw or any other suitable fastening method.

Preferably the first and second chute device each comprises a bottom member and two side members fastened to the bottom member such that the first and second transfer pipe can be accommodated between the side members and be supported by the bottom member. The first and second chute devices may also be designed such that two or more transfer pipes may be arranged in a single chute device. In addition to supporting the first and second transfer pipes, as mentioned above, the first and second chute devices will also take up transverse and vertical forces from the first and second transfer pipes and transfer these forces to the support unit.

The first and second chute device are each preferably provided with an inboard section that is attached to the support unit and an outboard section that faces the body of water and is curved downwards when the first and second chute device is attached to the support unit.

The first and second chute devices preferably support the first and second transfer pipes in a region where the first and second transfer pipes enter the support unit. This is because the first and second transfer pipes are going from a level that is lower than the support unit, for example a water surface or from below a water surface, and up to the support unit. The first and second transfer pipes are therefore subject to a certain degree of bending and the first and second chute devices are designed so that they will ensure that the first and second transfer pipes are not bent beyond their maximal bending radius. Thereby, permanent damage to the first and second transfer pipes are avoided.

The chute device is preferably provided with a funnel shape having a gradually increasing width in the transverse direction. Hence, the bottom member of the outboard section and the side members are preferably arranged with gradually increasing width towards an outer end portion of the chute devices that faces the body of water. This will allow the transfer pipes to bend vertically and transversally. However, the funnel-shape of the chute devices are designed so that no damage to the transfer pipes occur due to too large bending of the transfer pipes. Therefore, the outboard sections of the chute devices, i.e. the bottom member of the outboard section and/or the side members of the outboard section, are provided with a radius of curvature that is at least as large as, but preferably larger than the radius of curvature of the transfer pipes when they have reached their maximum bending radius.

The first and second tie-in device may each comprise a turnbuckle and/or a rigging screw and/or a hydraulic tensioner and/or a fixed rod of a predetermined length. Therefore, the spool pieces preferably comprise a fastening member to which the tie-in devices can be attached, where the fastening member is securely fastened to the spool piece, for example by welding, bolting or any other suitable fastening method or devices.

The first and second spool piece may each comprise a spool piece flange for attachment to a corresponding flange element on the first and second pipe element respectively.

Preferably, the first and second spool piece each comprises a first and a second fastening member for attachment of the first and second tie-in device to the first and second fastening member respectively, where the first and second fastening members are securely attached to the first and second spool pieces.

The fluid that is transported with the present invention may be in the form of a liquid, a gas or a mixture of liquid and gas. As mentioned above, the present invention may be used for transfer of a cryogenic fluid, for example LNG (liquefied natural gas).

It should be mentioned that there are several issues that are solved by the process system and fluid transfer system according to the present invention, especially when the fluid transferred through the transfer pipes is a cryogenic fluid, for example LNG (liquified natural gas). These issues include:

- The system enables recirculation and/or pre-cooling without the presence of the floating or non-floating facility.
- The system ensures that it is not shock cooled by quick transfer ramp-up and the system therefore enables recirculation and/or pre-cooling.
- The system ensures that pressure build-up in filling tanks in storage tanks on-shore or running GCU (Gas Combustion Unit—a burner which combusts the BOG (Boil Off Gas) in a controlled manner without the risk of releasing unburned natural gas to the atmosphere) in emptying tanks is avoided.
- The system is capable of going into a safe state in case of emergency since the system provides a quick and safe emergency shutdown and disconnect.
- The system ensures that dangerous pressure build-up due to trapped gas volumes is avoided.
- Furthermore, the system is preferably designed for vapor return.

Other features and advantages of the present invention will appear from the following description of a preferred, non-limiting embodiment of the invention, with reference to the figures where:

FIG. 1 schematically illustrates a process system according to the present invention where one end of two transfer pipes are connected to respective pipe elements of a process system arranged on a support unit and in the other end is connected to an operating station, and where the process system is fluidly connected to a vessel.

It should be mentioned that the same reference numbers are used for the same features of the present invention throughout in the figures.

Figure 1:
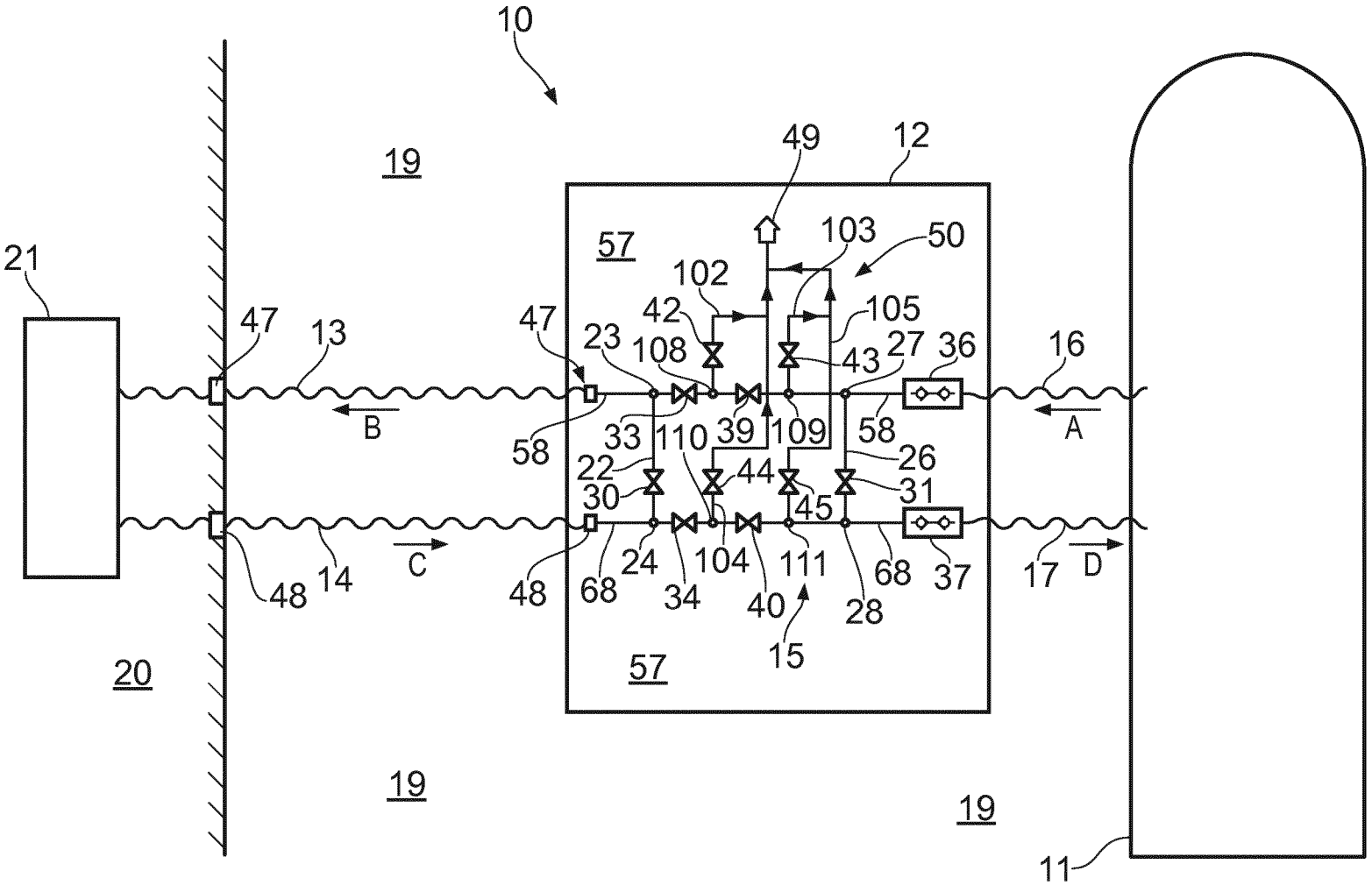
Figure 2:
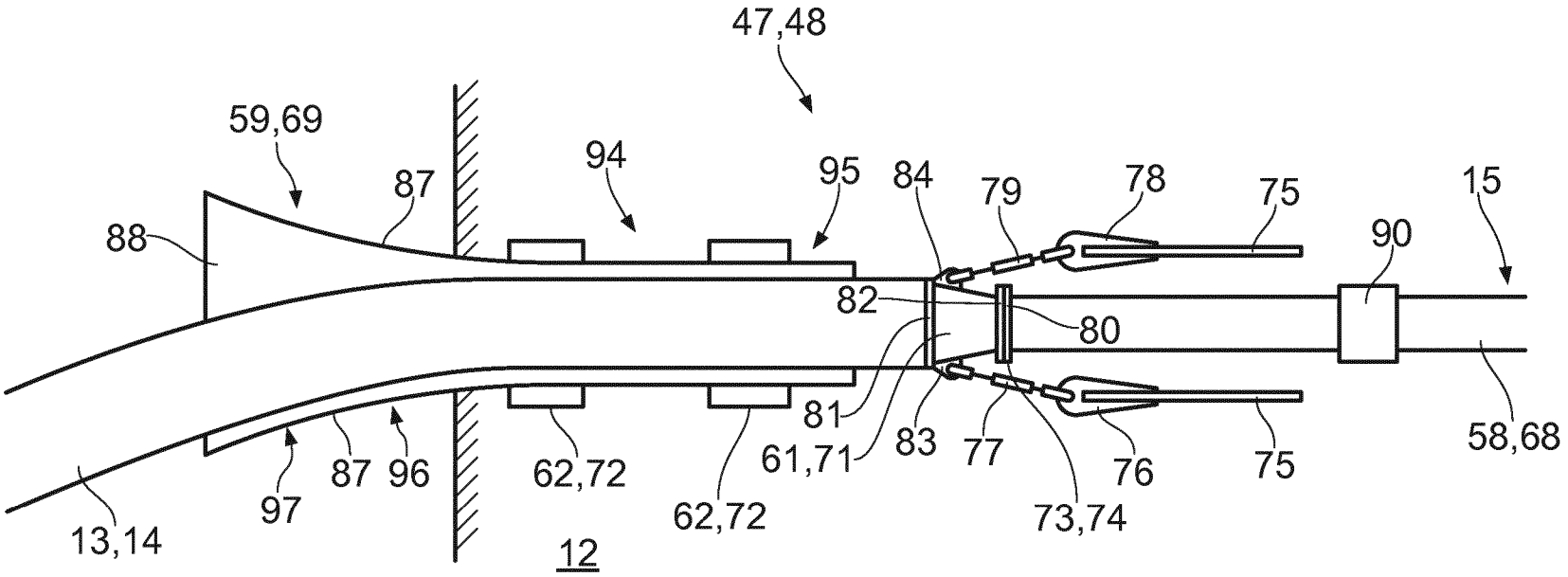
FIG. 2 shows a top view of a tie-in system for connecting/tying-in a transfer pipe to a pipe element, or a process system that the pipe element is part of, on the support unit as shown in FIG. 1.
Figure 3:
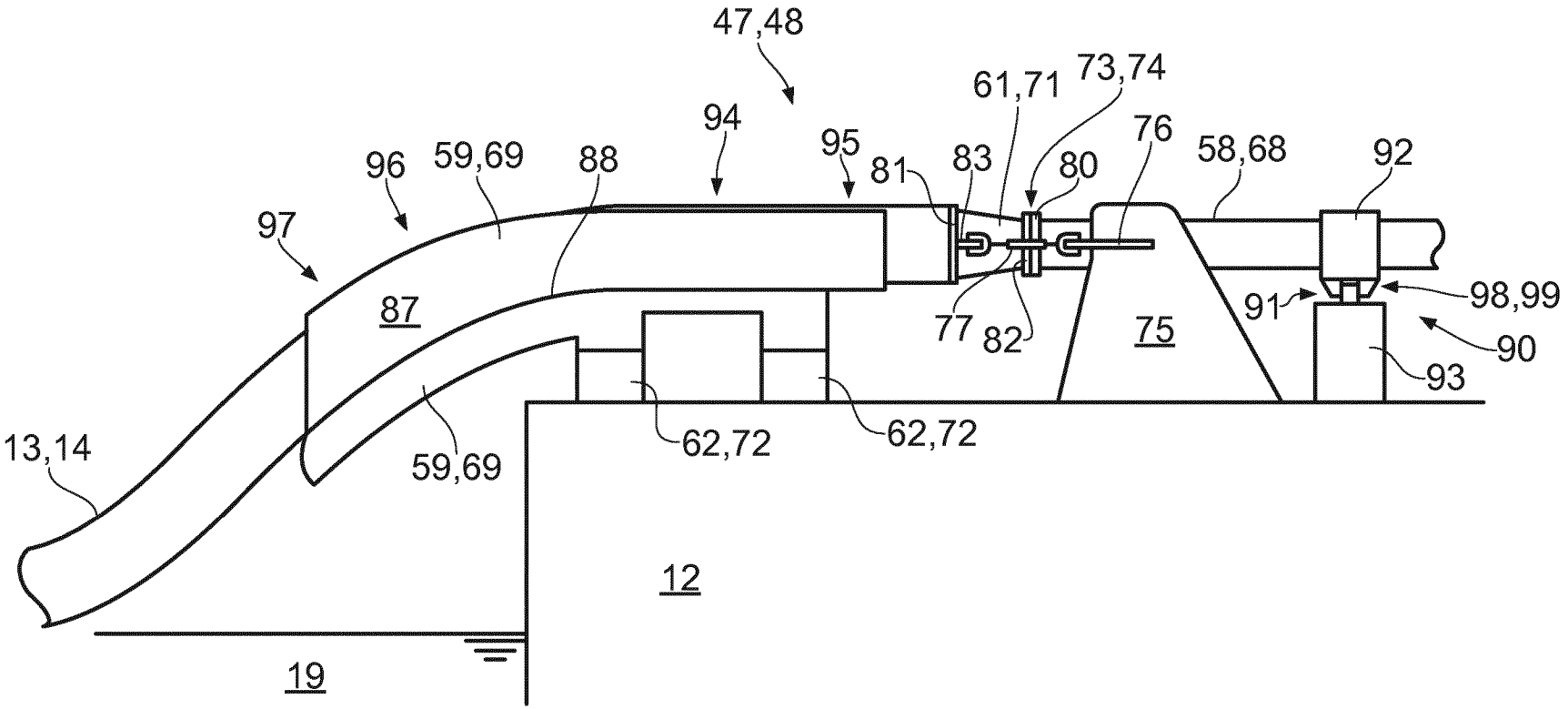
FIG. 3 shows a side view of the tie-in system shown in FIG. 2.
Figure 4:
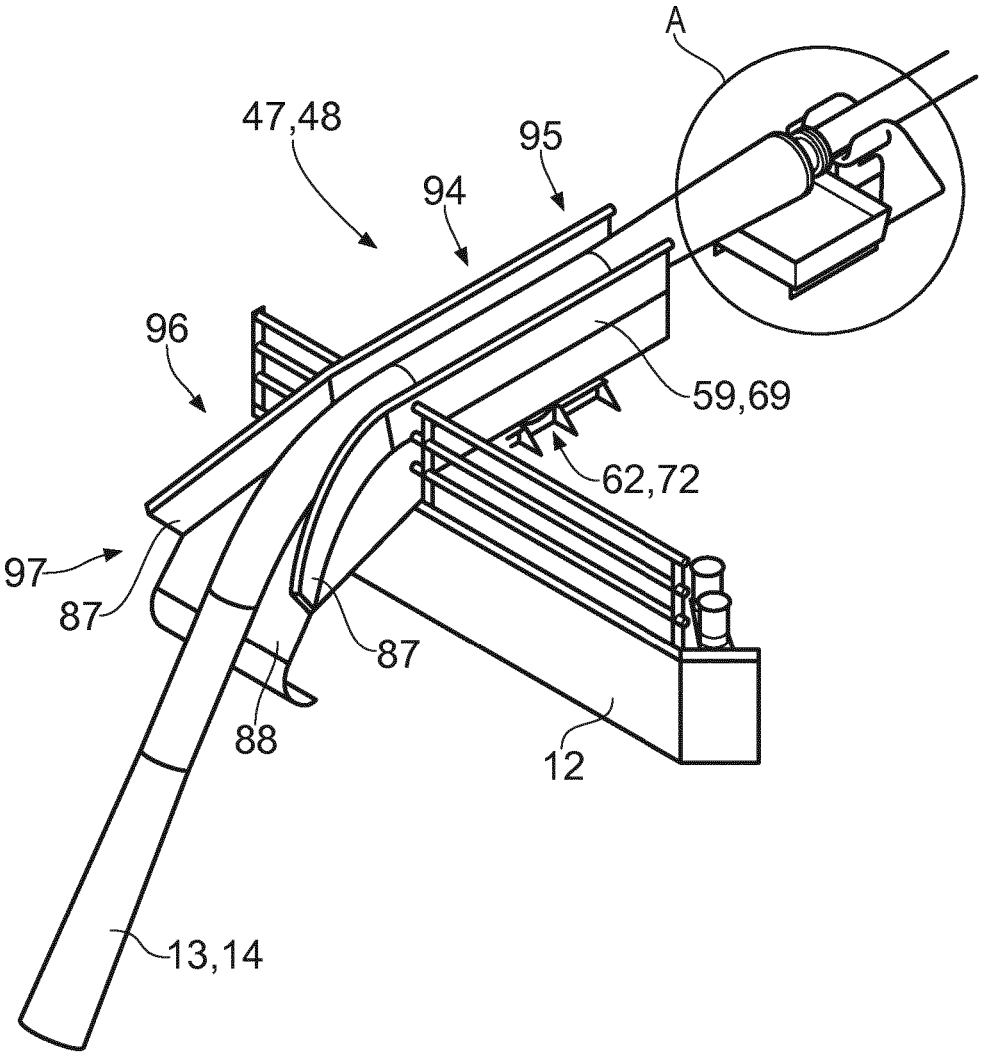
FIG. 4 shows a perspective view of the tie-in system shown in FIGS. 2 and 3.
Figure 5:
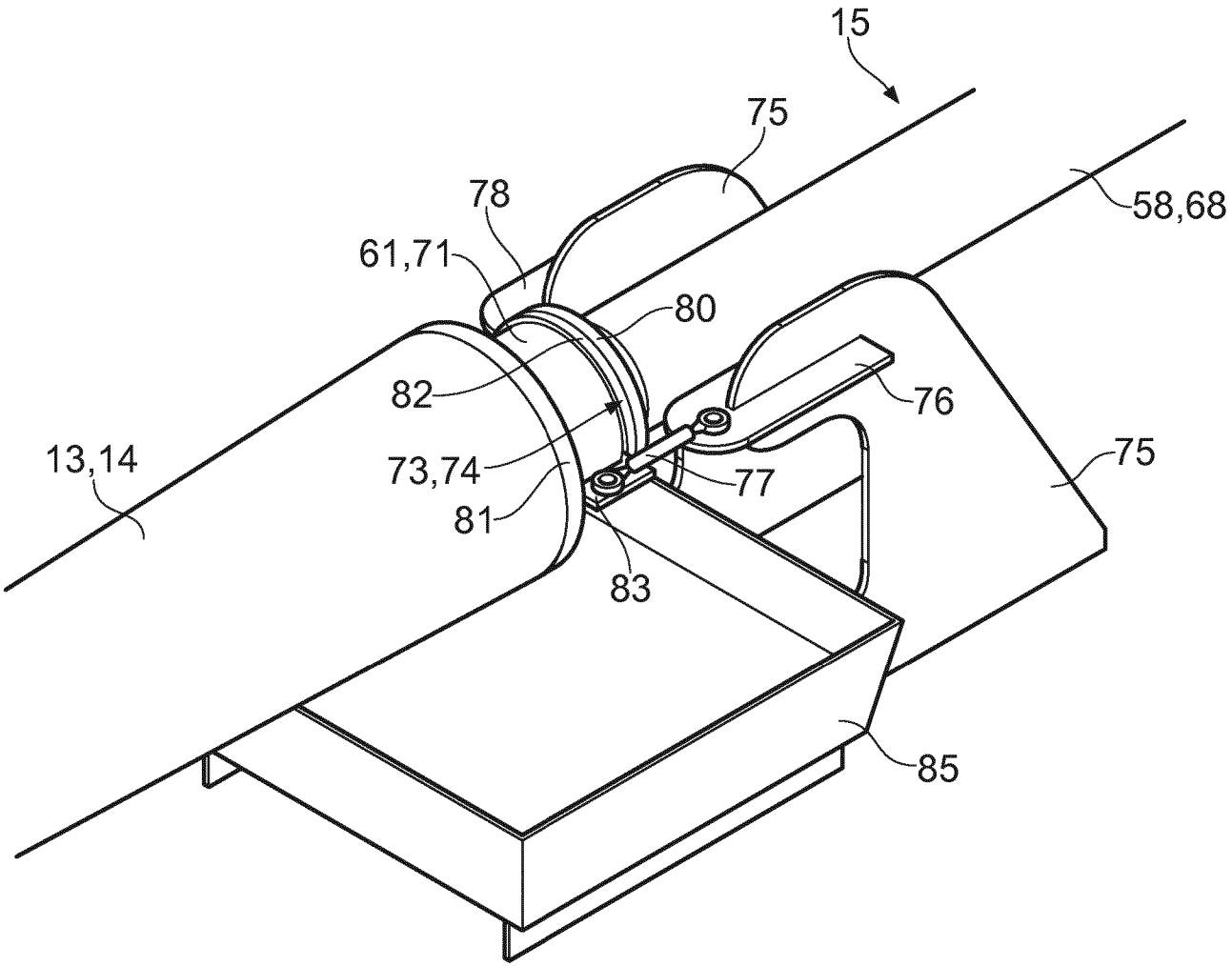
FIG. 5 shows an enlarged view of detail A indicated in FIG. 4.
Figure 8:
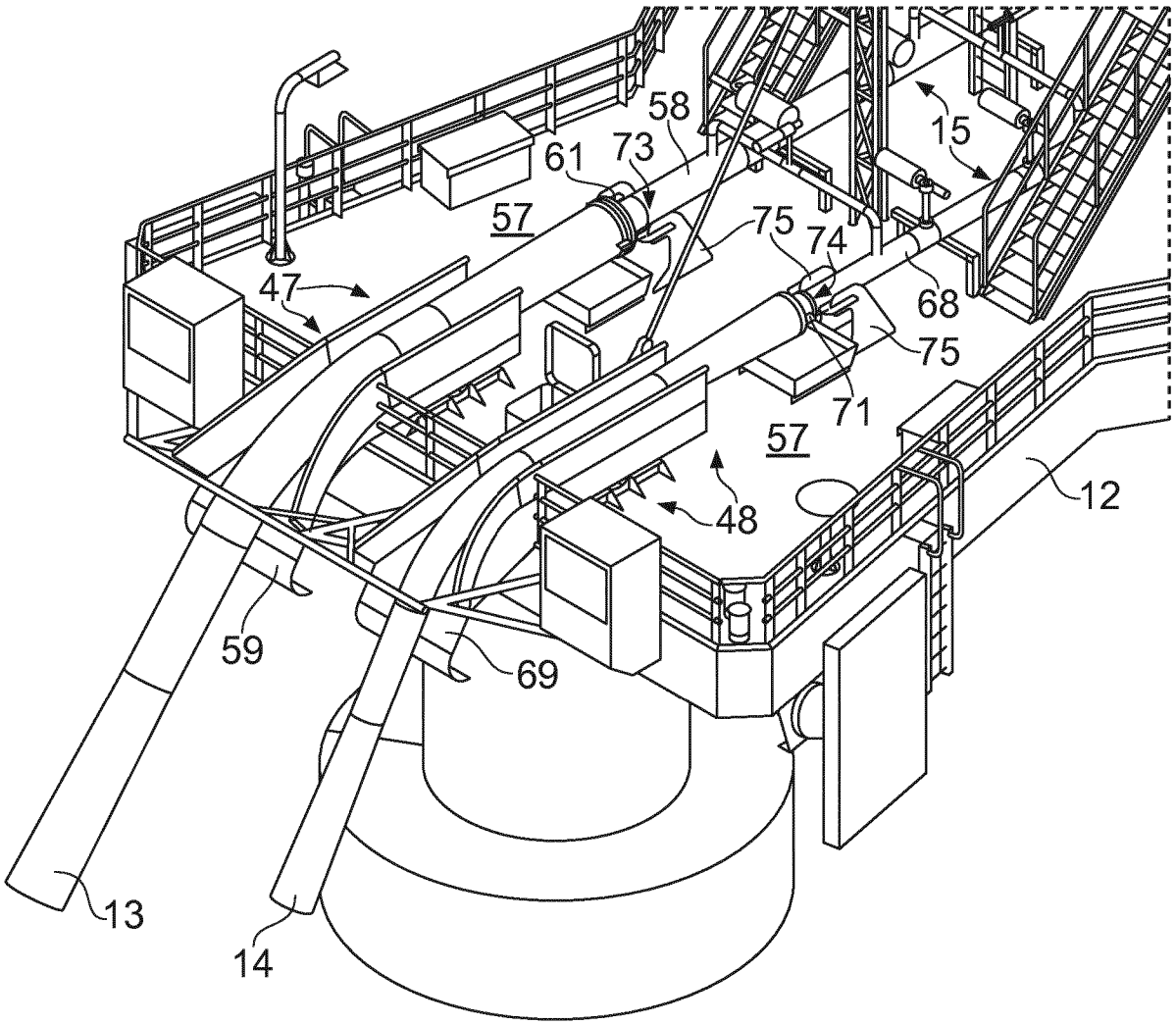
FIG. 8 shows two transfer pipes that are tied in to respective pipe elements in the same way as shown in FIGS. 2-7, where the pipe elements are part of a process system that is arranged on the support unit.

In FIG. 1 a process system 15 according to the present invention, and as partly shown in FIG. 8, is shown schematically arranged on a support unit 12. The process system 15 is arranged on a support unit 12 and preferably comprises two pipe elements 58, 68 that are connected to two respective transfer pipes 13, 14 as shown in FIGS. 1 and 8. The process system 15 may of course also comprise more than two pipe elements 58, 68 that are connected to a respective number of transfer pipes 13, 14. The transfer pipes 13, 14 are each preferably tied in to the support unit 12 with a tie-in system 47, 48.

In FIGS. 2-7, a fluid transfer system 10 comprising a tie-in system 47, 48 for tying in of a transfer pipe 13, 14 to the support unit 12 and connection of the transfer pipe 13, 14 to the process system 15 that comprises a pipe element 58, 68, is shown in detail, while FIG. 8 shows a fluid transfer system 10 comprising two transfer pipes 13, 14 that is connected to respective pipe elements 58, 68 of the process system 15 with a tie-in system 47, 48. The FIGS. 2-8 will be discussed first and then a detailed discussion of the process system 15 shown in FIG. 1 will follow.

As mentioned, in FIGS. 2-7 a process system 15 is shown that is connected to a transfer pipe 13, 14, or preferably a flexible hose, that extend from a receiving structure 21, for example a location on-shore or on a pier or a similar structure, or a floating structure, to a support unit 12, with a tie-in system 47, 48. The receiving structure 21 is preferably a location that includes a storage facility for a fluid, for example a cryogenic liquid such as LNG (Liquified Natural Gas), or a bulk material like a powder.

The support unit 12 may be a floating unit such as a semi-submersible platform, a non-gravity based non-floating unit, a gravity based non-floating unit, a ship, or other types of offshore or onshore units and terminals.

The receiving structure 21 can be a structure receiving fluid or bulk material that is transported from the support unit 12 through the transfer pipe 13, 14 or a structure that feeds or supplies fluid to the transfer pipe 13, 14 which is subsequently transported to the support unit 12 through the transfer pipes 13, 14. The receiving structure 21 may therefore be a floating or non-floating offshore or onshore terminal or any other type of floating or non-floating structure that is designed to receive fluid or bulk material that is transported through the transport pipe 13, 14 from the support unit 12 to the receiving structure 21. The receiving structure 21 may also be a floating or non-floating offshore or onshore terminal or any other type of floating or non-floating structure that is designed to supply fluid or bulk material for transport through the transport pipe 13, 14 from the receiving structure 21 to the support unit 12. It should also be mentioned that one or more tie-in systems 47, 48 may be installed on the support unit 12 and/or the receiving unit 21 as required in each instance.

A fluid transfer system 10 that comprises one or more tie-in systems 47, 48 for the at least one transfer pipe 13, 14, is also provided. Further, a process system 15 is arranged preferably on a deck 57 of the support unit 12, as indicated in FIG. 1, and can be connected to the at least one transfer pipe 13, 14. The process system 15 can be a more complex system of pipes that are arranged on the support unit 12 where the process system 15 comprises at least one pipe element 58, 68 that is connectable to the at least one transfer pipe 13, 14. Such a process system 15 is shown in FIG. 1 and will, as mentioned above, be further described below.

The tie-in system 47, 48 shown in detail in FIGS. 2-7 comprises a chute device 59, 69 that is adapted to be securely attached to the support unit 12. The chute device 59, 69 supports the transfer pipe 13, 14 that is arranged in the chute device 59, 69 and will take up forces and bending moments on the transfer pipe 13, 14 caused by high sea states, currents, winds, ice conditions and so on, and transfer the forces and bending moments to the support unit 12.

The support unit 12 is provided with at least one, but preferably two or more chute supports 62, 72 that are securely fastened to the support unit 12, for example by welding or with bolts, screws or any other suitable fastening devices. Consequently, the chute device 59, 69 is adapted to be securely attached to the chute supports 62, 72, for example by welding or with bolts, screws or any other suitable fastening devices.

The chute device 59, 69 comprises an inboard section 94 with an inner end portion 95 that will be arranged on the support unit, and an outboard section 96 that at least partly extends outside the outer edges of the support unit 12 and has an outer end portion 97. The chute device 59, 69 comprises a bottom member 88 and two side members 87 that are securely fastened to the bottom member 88 such that the chute device 59, 69 is funnel shaped and supports the transport pipe 13, 14 when it is arranged in the chute device 59, 69.

In the outboard section 96 of the chute device 59, 69 the bottom member 88 is preferably curved downwards in a direction from the inboard section 94 towards the outer end portion 97 of the chute device 59, 69 as indicated in the figures. The bottom member 88 preferably also gradually widens in a direction from the inboard section 94 towards the outer end portion 97 of the chute device 59, 69 as indicated in the figures. This shape of the chute device 59, 69 will allow the transfer pipe 13, 14 to bend vertically and transversally as the transfer pipe 13, 14 enters the support unit 12.

The funnel-shaped chute device 59, 69 is further designed so that no damage to the transfer pipe 13, 14 occurs due to too much bending of the transfer pipe 13, 14 as it enters the support unit 12. The bottom member 88 and the side members 87 of the outboard section 96 are preferably provided with a radius of curvature that is at least as large as, but preferably larger than the radius of curvature of the transfer pipe 13, 14 when it has reached its maximum bending radius without getting damaged. It is therefore ensured that the bending of the transfer pipe 13, 14 will be kept within the maximum bending limit of the transfer pipe as it enters the support unit 12.

The tie-in system 47, 48 further comprises a spool piece 61, 71 that may be adapted to be securely attached to the end of the transfer pipe 13, 14. The spool piece 61, 71 may be attached to the transfer pipe 13, 14 in a conventional way, for example with bolts, welding or any other suitable fastening means. Alternatively the spool piece can be disconnectably/releasably attached to the transfer pipe with a QCDC device (Quick Connection DisConnection) with hydraulic and/or mechanical brackets gripping the flange of the transfer pipe. It would also be possible to make the spool piece 61, 71 an integral part of the transfer pipe 13, 14 when the transfer pipe is fabricated. Alternatively, the spool piece 61, 71 may be integrally formed with the transfer pipe 13, 14 or securely connected to the transfer pipe 13, 14 as the transfer pipe 13, 14 is manufactured.

The spool piece 61, 71 is preferably made of steel and may be provided with a spool piece connector 81 for the attachment of the spool piece 61, 71 to the transfer pipe. The spool piece connector 81 can be a flange element that is an integral part of the spool piece 61, 71 or is securely attached to the spool piece 61, 71 with fastening means such as bolts, screw or other suitable fastening means.

The spool piece 61, 71 is preferably connected to the pipe element 58, 68 of the process system with a flange connection 73, 74. The spool piece 61, 71 is provided with a spool piece flange 82 that is adapted to be attached to a corresponding flange element 80 that is arranged on a pipe element 58, 68 of the process system 15 that is arranged on the support unit 12. The spool piece flange 82 can be attached to the flange element 80 to form the flange connection 73, 74 by welding or with a suitable number of conventional bolts (not shown in the figures), but any other suitable fastening means may be used.

Figure 6:
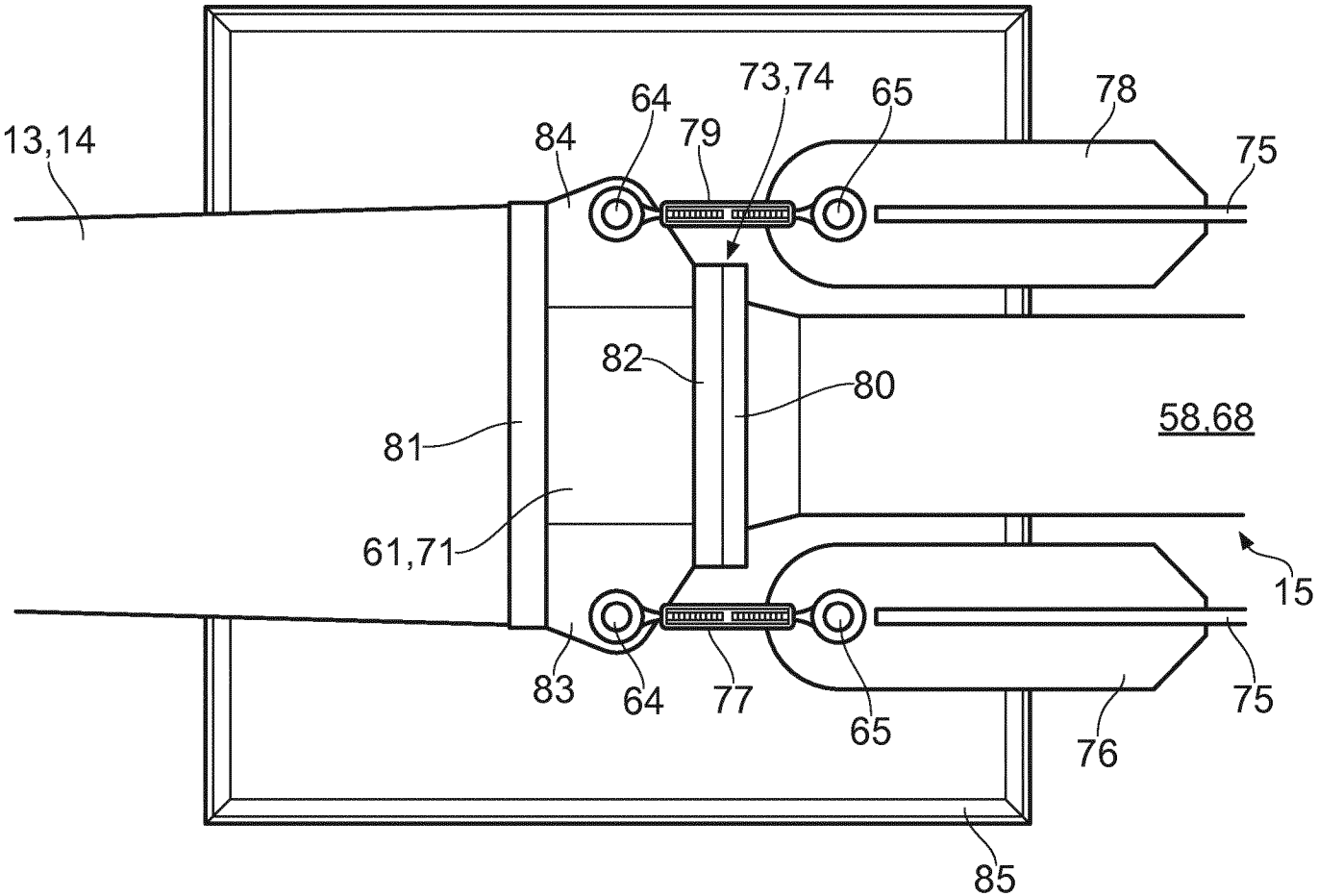
FIG. 6 shows a top view of detail A shown in FIG. 5.

Under the flange connection 73, 74 comprising the spool piece flange 82 and the flange element 80, a fluid collector 85 may be arranged as indicated in FIG. 6 in order to collect any fluid that that condenses or leaks from the flange connection.

Figure 7:
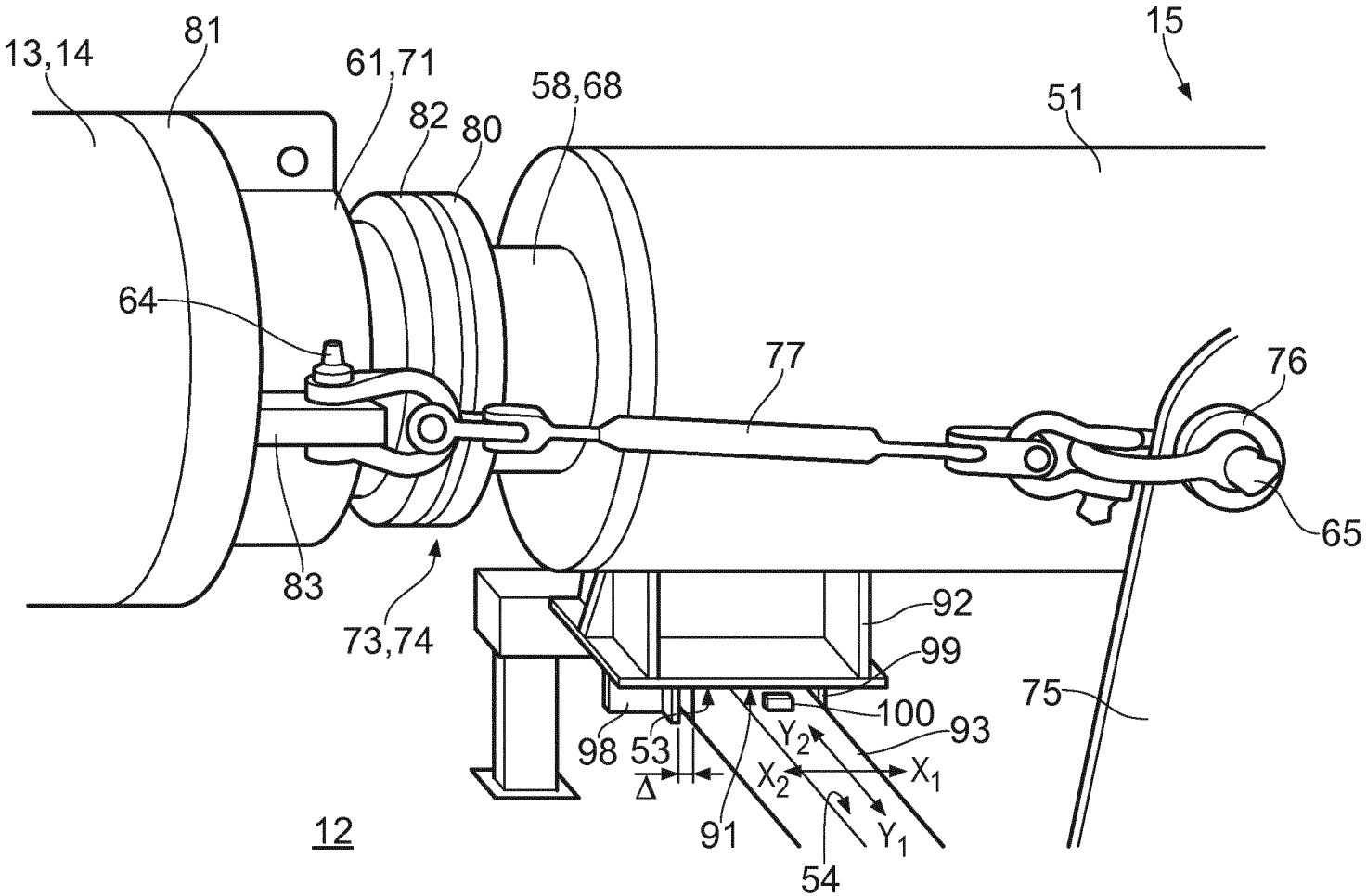
FIG. 7 shows a detailed view of the connection of the transfer pipe to the pipe element and a support device of the tie-in system shown in FIGS. 2-6, where the support device is designed to allow the pipe element, or the process system that the pipe element is part of, to move relative to the support unit.

The pipe element 58, 68 may be provided with a layer of insulation 51 as shown in FIG. 7 and is, as mentioned above, a part of a process system 15 as indicated in FIG. 1. The transfer pipes 13, 14 may alternatively each be connected to single pipes 58, 68 that are arranged on the support unit 12, i.e. the process system 15 is made up of single pipes 58, 68 that are each connected to a transfer pipe 13, 14 but are not fluidly interconnected.

The spool piece 61, 71 is further provided with at least one spool piece tie-in member but preferably two or more spool piece tie-in members 83, 84. The spool piece tie-in members 83, 84 may be an integral part of the spool piece 61, 71. Alternatively, the spool piece tie-in members 83, 84 can be securely attached to the spool piece 61, 71 with bolts, screw or any other suitable fastening means.

The spool piece tie-in members 83, 84 are adapted so that a tie-in device 77, 79 can be securely attached to the spool piece tie-in members 83, 84. The spool piece tie-in members 83, 84 may, for example, be provided with a bolt hole so that the tie-in devices 77, 79 can be attached to the spool piece tie-in members 83, 84 with respective tie-in bolts 64 as indicated in FIGS. 6 and 7.

The support unit 12 are further provided with one or more tie-in supports 75. The tie-in supports 75 are securely attached to the support unit 12, typically to a deck of the support unit 12, for example with bolts or screw or any other suitable fastening means, or by welding the tie-in supports 75 to the support unit 12.

The tie-in supports 75 may be provided with at least one tie-in member, but preferably two or more tie-in members 76, 78. The tie-in members 76, 78 are securely attached to the tie-in supports 75 by welding or with bolts or any other suitable fastening means. The tie-in members 76, 78 may be formed as an integral part of the tie-in support 75. The tie-in members 76, 78 are adapted so that the tie-in devices 77, 79 can be securely attached to respective tie-in members 76, 78 with bolts, welding or any other suitable fastening means. The tie-in members 76, 78 may, for example, each comprise a bolt hole so that the tie-in devices 77, 79 can be attached to the tie-in members 76, 78 with respective tie-in bolts 65 as indicated in FIGS. 6 and 7.

If the tie-in members 76, 78 is formed as an integral part of the tie-in supports 75, the tie-in devices will be adapted for the tie-in devices 77, 79 to be directly attached to the tie-in supports 75. The tie-in supports 75 may, for example, be provided with respective bolt holes so that the tie-in devices can be attached to the tie-in supports 75 with tie-in bolts, preferably of the same type as shown in FIGS. 6 and 7.

As indicated above, the tie-in system 47, 48 further comprises at least one tie-in device, but preferably two or more tie-in devices 77, 79. The tie-in devices 77, 79 are in one end adapted to be disconnectably connected to respective spool piece tie-in members 83, 84, for example with a bolt connection 64 as indicated above and shown in the figures. In the other end the tie-in devices 77, 79 are adapted to be disconnectably connected to respective tie-in members 76, 78, or directly to respective tie-in supports 75, for example with a bolt connection 65 as indicated above and shown in the figures.

When in use and the tie-in devices are attached to respective spool piece tie-in members 83, 84 and respective tie-in members 76, 78, the tie-in devices 77, 79 will transfer tension loads from the transfer pipe 13, 14 to the support unit 12. Thereby the flange connection 73, 74 connecting the transfer pipe 13, 14 to the pipe element 58, 68 will not need to take up any substantial tension loads from the transfer pipe 13, 14. The tie-in devices 77, 79 can be a mechanical holding device such as for example a turnbuckle, a rigging screw, a hydraulic tensioner, a fixed rod of a predetermined length or any other suitable device that is capable of transferring tension loads from the transfer pipe 13, 14 to the support unit 12. Typically two tie-in devices 77, 79 are arranged on opposite sides of both the spool piece 61, 71 and the pipe element 58, 68 as indicated in the figures, are used to take up the tension loads from the transfer pipe 13, 14, but obviously any other number of tie-in devices 76, 78 may be employed to take up the tension loads.

Although the forces of the transfer pipe 13, 14 are taken by the chute device 59, 69 and the tie-in supports 75, it is preferable that such loads are not transmitted to the fixed flange connection 73, 74 and the pipe element 58, 68 due to misalignment of the pipe element 58, 68 and the spool piece 61, 71, thermal expansion or contraction, difference in strain between the tie-in device 77, 79 and the pipe element 58, 68 or by other means. Therefore, the pipe element 58, 68 may be adapted to be able to move to a limited extent in the longitudinal/axial direction as indicated by arrows $X_1$ and $X_2$ in FIG. 7, and/or in the transverse direction as indicated by arrows $Y_1$ and $Y_2$ in FIG. 7.

The pipe element 58, 68 of the process system 15 is preferably supported on at least one support device 90, but preferably on a plurality of process system support devices 90 that comprises a lower support element 93 and an upper support element 92 as shown in FIG. 7. The lower support element 93 is preferably securely attached to the support unit 12, for example by welding, bolts or any other suitable fastening means. The upper support element 92 is preferably attached to the pipe element 58, 68, for example with bolts, one or more clamps, by welding or any other suitable fastening means. The upper support element 92 rests on the lower support element 93. Preferably the upper support element 92 is provided with a substantially plane upper support surface 53 and the lower support element 93 is provided with a corresponding substantially plane lower support surface 54 such that the upper support surface 53 and the lower support surface forms a slide bearing 91. The pipe element 58, 68 is thereby capable of moving in a substantially horizontal direction in response to forces from the transfer pipe 13, 14 acting on the pipe element 58, 68.

In order to limit the extent of the movement of the pipe element 58, 68 in a substantially horizontal direction, at least one limit stop 98, 99, 100 may be provided that will limit the movement of the pipe element 58, 68 in a longitudinal direction of the pipe element, i.e. the axial direction of the pipe element 58, 68 at the point where the pipe element 58, 68 is connected to the spool piece 61, 71, and/or a transverse direction, i.e. a direction that is substantially perpendicular to the longitudinal direction of the pipe element 58, 68.

As indicated in FIG. 7, the longitudinal movements of the pipe element 58, 68, as indicated by arrows $X_1$ and $X_2$, may be limited by providing the upper support element 92 with a first longitudinal limit stop 98 and/or a second longitudinal limit stop 99.

The first longitudinal limit stop 98 shown in FIG. 7, comprises a substantially vertical, structural element that is securely attached to the upper support element 92 projecting downwards from the upper support element 92 such that first longitudinal limit stop 98 will abut the lower support element 93 when the transfer pipe 13, 14 pushes the pipe element 58, 68 in the direction of arrow $X_1$ in FIG. 7. When the first longitudinal limit stop 98 abuts the lower support element 93, the pipe element 58, 68 is prevented from moving any further in the longitudinal direction away from the chute device 59, 69, i.e. in the direction of arrow $X_1$ in FIG. 7.

In a similar way, the second longitudinal limit stop 99 comprises a substantially vertical, structural element that is securely attached to the upper support element 92 projecting downwards from the upper support element 92 such that the second longitudinal limit stop 99 will abut the lower support element 93 when the pipe element 58, 68 is pushed in the direction of arrow $X_2$ in FIG. 7. When the second longitudinal limit stop 99 abuts the lower support element 93, the pipe element 58, 68 is prevented from moving any further in the direction of arrow $X_2$ in FIG. 7.

As further indicated in FIG. 7, the transverse movements of the pipe element 58, 68 may, as indicated by arrows $Y_1$ and $Y_2$, be limited by providing the lower support element 93 with a first transverse limit stop 100 and/or a second transverse limit stop (not visible in FIG. 7).

The first transverse limit stop 100 shown in FIG. 7, comprises a substantially vertical, structural element that is securely attached to the lower support element 93 projecting upwards from the lower support element 93 such that first transverse limit stop 100 will abut the upper support element 92 when the pipe element 58, 68 is pushed in the direction of arrow $Y_1$ in FIG. 7. When the first transverse limit stop 100 abuts the upper support element 92, the pipe element 58, 68 is prevented from moving any further in the transverse direction in the direction of arrow $Y_1$ in FIG. 7.

In a similar way, the second transverse limit stop on the opposite side of the pipe element 58, 68 as compared to the first transverse limit stop (not visible in FIG. 7 as mentioned above), comprises a substantially vertical, structural element that is securely attached to the lower support element 93 projecting upwards from the lower support element 93 such that second transverse limit stop will abut the upper support element 92 when the pipe element 58, 68 is pushed in the direction of arrow $Y_2$ in FIG. 7. When the second transverse limit stop abuts the upper support element 92, the pipe element 58, 68 is prevented from moving any further in the transverse direction in the direction of arrow $Y_2$ in FIG. 7.

The distance that the pipe element 58, 68 is allowed to move in the longitudinal direction is indicated by the Greek letter Δ in FIG. 7. The distance Δ may vary from one installation to another or one embodiment of the process system 15 to another, depending on various factors like the forces acting on the transfer pipes 13, 14, the elasticity of the tie-in device 77, 79, how much thermal expansion and contraction that must be allowed for and how much room there is on the support unit 12 for movement of the pipe element 58, 68 and the rest of the process system 15 in the longitudinal and the transverse directions.

In FIG. 8 a support unit 12 is shown where two transfer pipes 13, 14 are connected to two pipe elements 58, 68 of the process system 15 where each transfer pipe 13, 14 is tied in with two tie-in systems 47, 48 of the same design as described above. A first transfer pipe 13 is tied in with a first tie-in system 47 and connected to a first pipe element 58 of the process system 15 with a first flange connection 73 and a second transfer pipe 14 is tied in with a second tie-in system 48 and connected to a second pipe element 68 of the process system 15 with a second flange connection 74.

As described above, the first tie-in system 47 comprises a first chute device 59 in which the first transfer pipe 13 is arranged while the second tie-in system 48 comprises a second chute device 69 in which the second transfer pipe 14 is arranged. The first chute device 59 and the second chute device 69 are both preferably designed and securely attached to the support unit 12 as shown in FIGS. 2-7 and described in detail above.

The first tie-in system 47 comprises a first spool piece 61 that is securely attached to the first transfer pipe 13 in one end thereof. In the other end the first spool piece 61 is connectable to a first pipe element 58 of a process system 15 with a flange connection 73. The second tie-in system 48 comprises a second spool piece 71 that is securely attached to the second transfer pipe 14 in one end thereof. In the other end the second spool piece 71 is connectable to a second pipe element 68 of a process system 15 with a flange connection 74. The first flange connection 73 and the second flange connection 74 preferably have the same design as shown in FIGS. 2-7 and described in detail above. As already indicated above, the process system 15 may be designed with the first and second pipe elements 58, 68 only which are connected to the first and second transfer pipes 13, 14 respectively. Alternatively, as shown in FIGS. 1 and 8, the process system 15 may comprise a more complex pipe system 15 with a plurality of fluidly interconnected pipe elements, including the pipe elements 58, 68 that are connected to the transfer pipes 13, 14.

The first tie-in system 47 further comprises at least one tie-in device, but preferably two tie-in devices 77, 79 that are connected to respective spool piece tie-in members 83, 84 arranged on the first spool piece 61 and to respective tie-in members 76, 78 on tie-in supports 75 where the tie-in supports 75 are securely attached to the support unit 12. The second tie-in system 48 also comprises at least one tie-in device, but preferably two tie-in devices 77, 79 that are connected to respective spool piece tie-in members 83, 84 arranged on the second spool piece 71 and to respective tie-in members 76, 78 on tie-in supports 75 where the tie-in supports 75 are securely attached to the support unit 12. Generally, the tie-in devices 77, 79 of the first tie-in system 47 and the second tie-in system 48 are all preferably designed and attached to respective spool piece tie-in members 83, 84 and respective tie-in members 76, 78 as shown in FIGS. 2-7 and described in detail above.

Further, as described above, the tie-in devices 77, 79 of the first tie-in system 47 and the second tie-in system 48 can be mechanical holding devices such as turnbuckles, rigging screws, hydraulic tensioners, fixed rods of a predetermined length or any other suitable devices that are capable of transferring tension loads from the first and second transfer pipes 13, 14 to the support unit 12. Typically two tie-in devices 76, 78 arranged on opposite sides of the first spool piece 61 and the first pipe element 58 as indicated in the figures are used to take up the tension loads from the transfer pipe 13 and two tie-in devices 76, 78 arranged on opposite sides of the second spool piece 71 and the second pipe element 68 as indicated in the figures are used to take up the tension loads from the transfer pipe 14, but obviously any other number of tie-in devices 76, 78 may be employed to take up the tension loads from both the first transfer pipe 13 and the second transfer pipe 14.

The process system 15 shown in FIG. 1, and partially in FIG. 8, will now be described in more detail. In FIG. 1 the process system 15 is schematically shown arranged on the support unit 12. The process system 15 comprises the first pipe element 58 that can be connected to the transfer pipe 13 as shown in detail in FIGS. 2-8 and described in detail above. The second pipe element 68 can be connected to the transfer pipe 14 as shown in detail in FIGS. 2-8 and described in detail above.

In FIG. 1 the process system 15, as partially shown in FIG. 8, is shown schematically arranged on the support unit 12. The process system comprises the first pipe element 58 that is connected to the transfer pipe 13 as shown in detail in FIGS. 2-8 and described in detail above. The process system further comprises the second pipe element 68 that is connected to the transfer pipe 14 as shown in detail in FIGS. 2-8 and described in detail above.

FIG. 1 illustrates a typical use of the present invention where a floating or non-floating facility 11 may be a LNG-carrier 11 that carries LNG (Liquefied Natural Gas), the support unit 12 may be a floating unit 12 and the receiving structure 21 may be an onshore LNG-facility that is capable of receiving LNG from the LNG-carrier via the floating unit 12 and/or to send LNG to the LNG-carrier 11 via the floating unit 12. Obviously, other configurations of the floating or non-floating facility 11, the support unit 12 and the receiving structure 21 of the present invention is also possible.

The first transfer pipe 13 is tied in to the support unit 12 with a first tie-in system 47 as indicated in FIG. 1 and shown in detail in FIGS. 2-8 and described in detail above. The second transfer pipe 14 is tied in to the support unit 12 with a second tie-in system 48 as indicated in FIG. 1 and shown in detail in FIGS. 2-8 and described in detail above.

The first transfer pipe 13 and the second transfer pipe are further connected to a receiving structure 21. As indicated in FIG. 1, the receiving structure may be an onshore structure or facility, but may obviously also be arranged offshore, either as a floating structure or arranged on legs, a pier or some other type of structure that is fixed to the seabed.

It should be noted that although two transport pipes 13, 14 are shown in FIG. 1, it would be possible to provide the system with any desirable number of transport pipes depending on requirements for the project in question.

The receiving structure 21 can be a structure receiving fluid that is transported from the support unit 12 through the first and second transfer pipes 13, 14 or a structure that feeds or supplies fluid to the first and second transfer pipes 13, 14 which is subsequently transported to the support unit 12. The receiving structure 21 may therefore be a floating or non-floating offshore or onshore terminal or any other type of floating or non-floating structure that is designed to receive fluid that is transported through the first and second transfer pipes 13, 14 from the support unit 12 to the receiving structure 21. The receiving structure 21 may also be a floating or non-floating offshore or onshore terminal or any other type of floating or non-floating structure that is designed to supply fluid for transport through the first and second transfer pipes 13, 14 from the receiving structure 21 to the support unit 12. It should also be mentioned that one or more tie-in systems 47, 48 may be installed on the support unit 12 and/or the receiving unit 21 as required in each case.

The process system 15 may further comprise a first cross over pipe 22 that is fluidly connected to the first pipe element 58 with a first cross pipe connection 23 and to the second pipe element 68 with a second cross pipe connection 24. A fluid can thereby be flown through the first cross over pipe 22 from the first pipe element 58 to the second pipe element 68 or in the opposite direction. In the first cross over pipe 22 there is preferably provided a first valve device 30 so that the flow of fluid through the first cross over pipe 22 can be controlled.

The process system 15 may further also comprise a second cross over pipe 26 that is fluidly connected to the first pipe element 58 with a third cross pipe connection 27 and to the second pipe element 68 with a fourth cross pipe connection 28. A fluid can thereby be flown through the second cross over pipe 26 from the first pipe element 58 to the second pipe element 68 or in the opposite direction. In the second cross over pipe 26 there is preferably provided a second valve device 31 so that the flow of fluid through the second cross over pipe 26 can be controlled.

The first valve device 30 and the second valve device 31 are preferably standard valve devices that are commercially available and is not further described herein. The first, second, third and fourth cross pipe connections 23, 24, 27, 28 may be formed with standard T-junction pipe elements which will allow fluid to flow through the first pipe element 58 and/or the second pipe element 68 and/or the first cross over pipe 22 and/or the second cross over pipe 26 depending on how the first valve device 30, the second valve device 31 and other valve devices that the process system 15 may be provided with, are set.

The process system 15 is preferably further provided with various valve devices for emergency situations and/or regulation of fluid flow through the process system 15.

The first pipe element 58 is preferably provided with a first cargo valve device 39 for regulation of fluid flow through the first pipe element 58. The first cargo valve 39 is preferably arranged in the first pipe element 58 between the first cross pipe connection 23 and the third cross pipe connection 27.

Further, the second pipe element 68 is preferably provided with a second cargo valve device 40 for regulation of fluid flow through the second pipe element 68. The second cargo valve 40 is preferably arranged in the second pipe element 68 between the second cross pipe connection 24 and the fourth cross pipe connection 28.

The first pipe element 58 may further be disconnectably connected to a first aerial hose 16. Similarly, the second pipe element 68 may be disconnectably connected to a second aerial hose 17.

With this arrangement of the first and second cargo valve devices 39, 40 and the first and second cross over pipes 22, 26 that each fluidly connects the first pipe element 58 and the second pipe element 68, recirculation of fluid and/or pre-cooling of the first and second transfer pipes 13, 14 is enabled without the presence of the floating or non-floating facility 11. Furthermore, tedious pre-cooling activities with the LNGC present is avoided and it is ensured that the first and second transfer pipes 13, 14 and/or the first and second pipe elements 58, 68 are not shock cooled by quick transfer ramp-up when the fluid that is transferred through the fluid transfer system 10 is a cryogenic fluid like for example LNG.

As can easily be seen in FIG. 1, by closing the first cargo valve device 39 and the second cargo valve device 40 and opening the first valve device 30 in the first cross over pipe 22, fluid may be flowed from the receiving structure 21 through the second transfer pipe 14 as indicated with the arrow C, further through the first cross over pipe 22 and back to the receiving structure 21 through the first transfer pipe 13 as indicated with the arrow B. By gradually using cooler fluid, the first and second transfer pipes 13, 14 can be gradually cooled until they reach a temperature that is not going to cause any shock cooling of the first and/or second transfer pipes 13, 14 that could happen if a cryogenic fluid is transferred through the first and second transfer pipes 13, 14 without precooling of the first and second transfer pipes. The flow direction may obviously also run in the opposite direction.

Similarly, by closing the first and second cargo valves 39, 40 and opening the second valve device 31 in the second cross over pipe 26, fluid may be flowed from the floating or non-floating facility 11 through the first aerial hose 16 as indicated with the arrow A, further through the second cross over pipe 26 and back to the floating or non-floating facility 11 through the second aerial hose 17 as indicated with the arrow D. By gradually using cooler fluid, the first and second aerial hoses 16, 17 can be gradually cooled until they reach a temperature that is not going to cause shock cooling of the first and/or second aerial hoses 16, 17 that could happen if a cryogenic fluid is transferred through the first and second aerial hoses 16, 17 without precooling of the first and second aerial hoses. The flow direction may obviously also run in the opposite direction.

Of course, when the aerial hoses 16, 17 are connected to a floating or non-floating facility 11, for example an LNG-carrier, for transfer of a cryogenic fluid like LNG, the fluid transfer system 10 that will transfer a cryogenic fluid from the floating or non-floating facility 11 to the receiving structure 21 via the support unit 12, may be precooled. Fluid can be flowed through the first aerial hose 16, further through the first pipe element 58 on the support unit 12, further through the first transfer pipe 13 to the receiving structure 21 and then back to the floating or non-floating structure 11 through the second transfer pipe 14, further through the second pipe element 68 on the support unit 12, further through the second aerial hose 17 and back to the floating or non-floating structure. This path is indicated in FIG. 1 by following arrows A-B-C-D in that order.

If the receiving structure 21 is storing a cryogenic fluid that is transferred to the floating or non-floating structure 11 via the support unit 12, the fluid transfer system 10 may be precooled in a similar manner. Fluid can for example be flowed through the second transfer pipe 14, further through the second pipe element 68 on the support unit 12, and further through the second aerial hose 17 to the floating or non-floating structure 11, and then back to the receiving structure 21 through the first aerial hose 16, further through the first pipe element 58 on the support unit 12, and further through the first transfer pipe 13 to the receiving structure 21. This path is indicated in FIG. 1 by following arrows C-D-A-B in that order. The flow direction may obviously also run in the opposite direction.

Finally, it should be noted that the fluid transfer system 10 may be precooled by flowing a fluid through the two paths, i.e. the first path through the first transfer pipe 13—the first pipe element 58—the first aerial hose 16 and the second path through the second transfer pipe 14—the second pipe element 68—the second aerial hose 17, in the same direction. Hence, the fluid transfer system 10 may be precooled by flowing a gradually cooler fluid through the two paths in the same direction, either from the receiving structure 21 to the floating or non-floating structure 11 or in the opposite direction from the floating or non-floating structure 11 to the receiving structure 21.

During a transfer operation, as can easily be seen in FIG. 1, by opening all valve devices 33, 34, 36, 37, 39, 40 in the first and second pipe elements (58, 68) and closing the first valve device 30 in the first cross over pipe 22 and closing the second valve device 31 in the second cross over pipe 26, fluid may be flowed from the receiving structure 21 to the floating or non-floating structure 11 through the second transfer pipe 14, further through the second pipe element 68 on the support unit 12, and further through the second aerial hose 17 to the floating or non-floating structure 11. Simultaneously, fluid may be flowed from the floating or non-floating structure 11 through the first aerial hose 16, further through the first pipe element 58 on the support unit 12, and further through the first transfer pipe 13 to the receiving structure 21. The flow direction may obviously also run in the opposite direction, but also through the two paths in the same direction.

The first pipe element 58 may further be disconnectably connected to a first aerial hose 16, preferably with a first break away coupling 36. In case of any emergency situation, the first aerial hose 16 may therefore be quickly disconnected from the first pipe element 58. Similarly, the second pipe element 68 may be disconnectably connected to a second aerial hose 17, preferably with a second break away coupling 37. In case of any emergency situation, the second aerial hose 17 may therefore be quickly disconnected from the second pipe element 68. That the first aerial hose 16 and the second aerial hose 17 can be quickly disconnected from the first and second pipe element 58, 68 respectively is important in case a hazardous substance, like for example LNG, is transported through the first and second aerial hoses 16, 17 and an emergency situation may arise.

The first breakaway coupling 36 is used to separate the first pipe element 58 and the first aerial hose 16, but preferably also to stop the flow of fluid through the first pipe element 58 and the first aerial hose 16. Similarly, the second breakaway coupling 37 is used to separate the second pipe element 68 and the second aerial hose 17, but preferably also to stop the flow of fluid through the second pipe element 68 and the second aerial hose 17. The breakaway couplings 36, 37 are preferably a standard type of breakaway couplings that are commercially available and their design will not be any further described herein.

The process system 15 shown in FIG. 1 is preferably further provided with a first emergency shut down valve device (ESD) 33 arranged in the first pipe element 58. The first emergency shut down valve device 33 is, like the first cargo valve 39, preferably arranged in the first pipe element 58 between the first cross pipe connection 23 and the third cross pipe connection 27. It should be noted that the order in which the first cargo valve 39 and the first emergency shut down valve device 33 is arranged in the first pipe element 58, i.e. their mutual position relative to the first cross pipe connection 23 and the third cross pipe connection 27, is unimportant.

The process system 15 shown in FIG. 1 is preferably also provided with a second emergency shut down valve device (ESD) 34 arranged in the second pipe element 68. The second emergency shut down valve device 34 is, like the second cargo valve 39, preferably arranged in the second pipe element 68 between the second cross pipe connection 24 and the fourth cross pipe connection 28. It should be noted that the order in which the second cargo valve 40 and the second emergency shut down valve device 34 is arranged in the second pipe element 68, i.e. their mutual position relative to the second cross pipe connection 24 and the fourth cross pipe connection 28, is unimportant.

The first and second emergency shut down valve devices 33, 34 are used to stop the flow of fluid through the first pipe element 58 and the second pipe element 68 respectively in case there is an emergency situation, for example a leakage of fluid from the process system 15. The emergency shut down valve devices 33, 34 are preferably a standard type of emergency shut down valve devices that are commercially available and their design will not be any further described herein.

The process system preferably comprises a vent system 50 that is capable of venting or removing a fluid such as LNG from one, some or all of the first pipe element 58, the second pipe element 68, the first cross over pipe 22, the second cross over pipe and any other pipe element of the process system 15 in which a hazardous fluid could be trapped. The first aerial hose 16 and the second aerial hose 17 are preferably vented from the floating or non-floating structure 11. Similarly, the first transfer pipe 13 and the second transfer pipe 14 are preferably vented from the receiving structure 21. Alternatively, any trapped fluid in the transfer pipes 13, 14 and aerial hoses 16, 17 may be vented by the vent system 50 by connecting additional vent pipes (not shown in the figures) to the vent mast 49.

The vent system 50 comprises a vent mast 49 and a number of pipes that are connected to the vent mast 49 such that any potentially trapped fluid, such as LNG, may be vented from the pipe elements 58, 68, 22, 23 on the support unit 12 which are not fluidly connected to the receiving structure 21 or the floating or non-floating structure 11. As shown in FIG. 1, a first vent pipe 102 is fluidly connected to the vent mast 49 and the first pipe element 58 in a first vent pipe connection 108, and a second vent pipe 103 is also fluidly connected to the vent mast 49 and to the first pipe element 58 in a second vent pipe connection 109. Further a third vent pipe 104 is fluidly connected to the vent mast 49 and the second pipe element 68 in a third vent pipe connection 110, and a fourth vent pipe 105 is fluidly connected to the vent mast 49 and the second pipe element 68 in a fourth vent pipe connection 111. It should be noted that the vent pipe connections 108, 109, 110, 111 may be arranged in various different configurations in the process system 15 depending on the layout and presence of emergency shut down valve devices 33, 34 and/or the breakaway couplings 36, 37 and/or the properties of the fluid that is transferred, for example whether the fluid is pressurized or non-pressurized and/or explosive or non-explosive and/or hazardous or non-hazardous. Hence other configurations will work and enable venting of potentially trapped fluid and one example is shown in FIG. 1.

In the first vent pipe 102 there is provided a first pressure relief valve 42, in the second vent pipe 103 there is provided a second pressure relief valve 43, in the third vent pipe 102 there is provided a third pressure relief valve 44 and in the fourth vent pipe 105 there is provided a fourth pressure relief valve 45. If the pressure in the process system 15 increases to a an unacceptably high level, one, some or all of the first, second, third and fourth pressure relief valves 42, 43, 44, 45 will open and let gas flow out through the first, second, third and fourth vent pipes 102, 103, 104, 105 respectively.

The first vent pipe connection 108 may for example, as shown in FIG. 1, be arranged in the first pipe element 58 between the first emergency shut down valve 33 and the first cargo valve device 39. Similarly, the third vent pipe connection 110 may for example, as shown in FIG. 1, be arranged in the second pipe element 68 between the second emergency shut down valve 34 and the second cargo valve device 40.

The second vent pipe connection 109 may for example, as shown in FIG. 1, be arranged in the first pipe element 58 between the first break away coupling 36 and the first cargo valve device 39. Similarly, the forth vent pipe connection 111 may for example, as shown in FIG. 1, be arranged in the second pipe element 68 between the second break away coupling 37 and the second cargo valve device 40.

As mentioned above, the process system 15 preferably comprises a vent system 50 so that a fluid may be vented from the process system 15 if that is needed. That can be desirable if the fluid transfer system 10 is used to transfer a fluid under pressure and/or a fluid that expands when vaporizing and/or a hazardous fluid such as LNG. Generally, the vent mast 49 is preferably connected to the first pipe element 58 and the second pipe element 68 and any further pipe element of the process system 15 such that any fluid that is trapped in the process system 15 when the cargo valve devices 39, 40 and/or the emergency shut down valve devices 33, 34 and/or the breakaway couplings 36, 37 are closed, can be vented through the vent mast 49 or vented through the receiving structure or floating or non-floating structure.

Although the forces of the transfer pipes 13, 14 are taken by the first and second chute devices 59, 69 respectively and the respective tie-in supports 75, it is preferable that such loads are not transmitted to the first and second flange connection 73, 74 and the first and second pipe element 58, 68 due to misalignment of the first pipe element 58 and the first spool piece 61 and/or the second pipe element 68 and the second spool piece 71, or due to thermal expansion or contraction, or due to difference in strain between the tie-in device 77, 79 and the pipe element 58, 68, or by other means. Therefore, the first and second pipe element 58, 68 may be adapted to be able to move horizontally to a limited extent in the longitudinal/axial direction, as indicated by the arrows $X_1$ and $X_2$ in FIG. 7, and/or in the transverse direction as indicated by arrows $Y_1$ and $Y_2$ in FIG. 7.

The first and second pipe elements 58, 68 are preferably supported on at least one support device, but preferably a plurality of process system support devices 90 that comprises a lower support element 93 and an upper support element 92 as shown in FIG. 7. The lower support element 93 is preferably securely attached to the support unit 12, for example by welding, bolts or any other suitable fastening means. The upper support element 92 is preferably attached to the pipe element 58, 68, for example with bolts, one or more clamps, by welding or any other suitable fastening means. The upper support element 92 rests on the lower support element 93. Preferably the upper support element 92 is provided with a substantially plane upper support surface 54 and the lower support element 93 is provided with a corresponding substantially plane lower support surface 54 such that the upper support surface 53 and the lower support surface forms a slide bearing 91. The first and second pipe elements 58, 68 are thereby capable of moving in a substantially horizontal direction in response to forces from the first and second transfer pipes 13, 14 acting on the first and second pipe elements 58, 68. Consequently, the entire process system 15 is capable of moving horizontally relative to the support unit 12 in response to external forces acting on the process system 15, typically from the first and second transfer pipes 13, 14.

In order to limit the extent of the movement of the first and second pipe elements 58, 68 in a substantially horizontal direction, at least on limit stop 98, 99, 100 may be provided that will limit the movement of the first and second pipe elements 58, 68 in a longitudinal direction of the first and second pipe elements, i.e. the axial direction of the first and second pipe elements 58, 68 at the point where the first and second pipe elements 58, 68 are connected to the first spool piece 61 and the second spool piece 71 respectively, and/or a transverse direction, i.e. a direction that is substantially perpendicular to the longitudinal/axial direction of the first and second pipe elements 58, 68.

As indicated in FIG. 7, the longitudinal movements of the first and second pipe elements 58, 68, as indicated by arrows $X_1$ and $X_2$ in FIG. 7, may be limited by providing the upper support element 92 of at least one of the process system support devices 90 with a first longitudinal limit stop 98 and/or a second longitudinal limit stop 99. It should, however, be noted that the first longitudinal limit stop and/or the second longitudinal limit stop need not be provided on any of the process system support devices 90 but may be provided separately on the support unit 12.

The first longitudinal limit stop 98 may comprise a substantially vertical, structural element that is securely attached to the upper support element 92 projecting downwards from the upper support element 92 such that first longitudinal limit stop 98 will abut the lower support element 93 when the first and second transfer pipes 13, 14 pushes the first and second pipe elements 58, 68 respectively in the direction of arrow $X_1$ in FIG. 7. When the first longitudinal limit stop 98 abuts the lower support element 93, the first and second pipe element 58, 68 are prevented from moving any further in the longitudinal direction away from the first and second chute devices 59, 69, i.e. in the direction of arrow $X_1$ in FIG. 7.

In a similar way, the second longitudinal limit stop 99 may comprise a substantially vertical, structural element that is securely attached to the upper support element 92 projecting downwards from the upper support element 92 such the that second longitudinal limit stop 99 will abut the lower support element 93 when the first and second pipe elements 58, 68 are pushed in the direction of arrow $X_2$ in FIG. 7. When the second longitudinal limit stop 99 abuts the lower support element 93, the first and second pipe elements 58, 68 are prevented from moving any further in the direction of arrow $X_2$ in FIG. 7.

As further indicated in FIG. 7, the transverse movements of the first and second pipe elements 58, 68, as indicated by arrows $Y_1$ and $Y_2$ in FIG. 7, may be limited by providing the lower support element 93 of at least one of the process system support devices 90 with a first transverse limit stop 100 and/or a second transverse limit stop (not visible in FIG. 7). It should be noted that the first transverse limit stop and/or the second transverse limit stop need not be provided on any of the process system support devices 90 but may be provided separately on the support unit 12.

The first transverse limit stop 100 comprises a substantially vertical, structural element that is securely attached to the lower support element 93 projecting upwards from the lower support element 93 such that the first transverse limit stop 100 will abut the upper support element 92 when the first and second pipe elements 58, 68 are pushed in the direction of arrow $Y_1$ in FIG. 7. When the first transverse limit stop 100 abuts the upper support element 92, the first and second pipe elements 58, 68 are prevented from moving any further in the transverse direction in the direction of arrow $Y_1$ in FIG. 7.

In a similar way, the second transverse limit stop on the opposite side of the pipe element 58, 68 as compared to the first transverse limit stop (not visible in FIG. 7 as mentioned above), comprises a substantially vertical, structural element that is securely attached to the lower support element 93 projecting upwards from the lower support element 93 such that second transverse limit stop will abut the upper support element 92 when the first and second pipe elements 58, 68 are pushed in the direction of arrow $Y_2$ in FIG. 7. When the second transverse limit stop abuts the upper support element 92, the first and second pipe elements 58, 68 are prevented from moving any further in the transverse direction in the direction of arrow $Y_2$ in FIG. 7.

The distance that the first and second pipe elements 58, 68 are allowed to move in the longitudinal direction, and hence the distance that the process system 15 is allowed to move in the longitudinal direction $X_1$-$X_2$, is indicated by the Greek letter Δ in FIG. 7. The distance Δ may vary from one installation to another depending on various factors like how much thermal expansion and contraction that must be allowed for and how much room there is on the support unit 12 for movement of the pipe element 58, 68 and the process system 15 in the longitudinal direction $X_1$-$X_2$. Although not indicated in FIG. 7, the same may apply to the movement of the first and second pipe elements 58, 68 in the transverse direction $Y_1$-$Y_2$.

It should be noted that the design of the embodiment of the longitudinal/axial and transverse limit stops 98, 99, 100 described above and shown in FIG. 7 are examples of a design that will work with the present process system 15. However, there are many other designs that could be employed to limit the movement of the process system 15 on the support elements 92 and it should be understood that the limiting of the movement of the process system 15 is not limited to using the design shown in FIG. 7.

Figure 9:
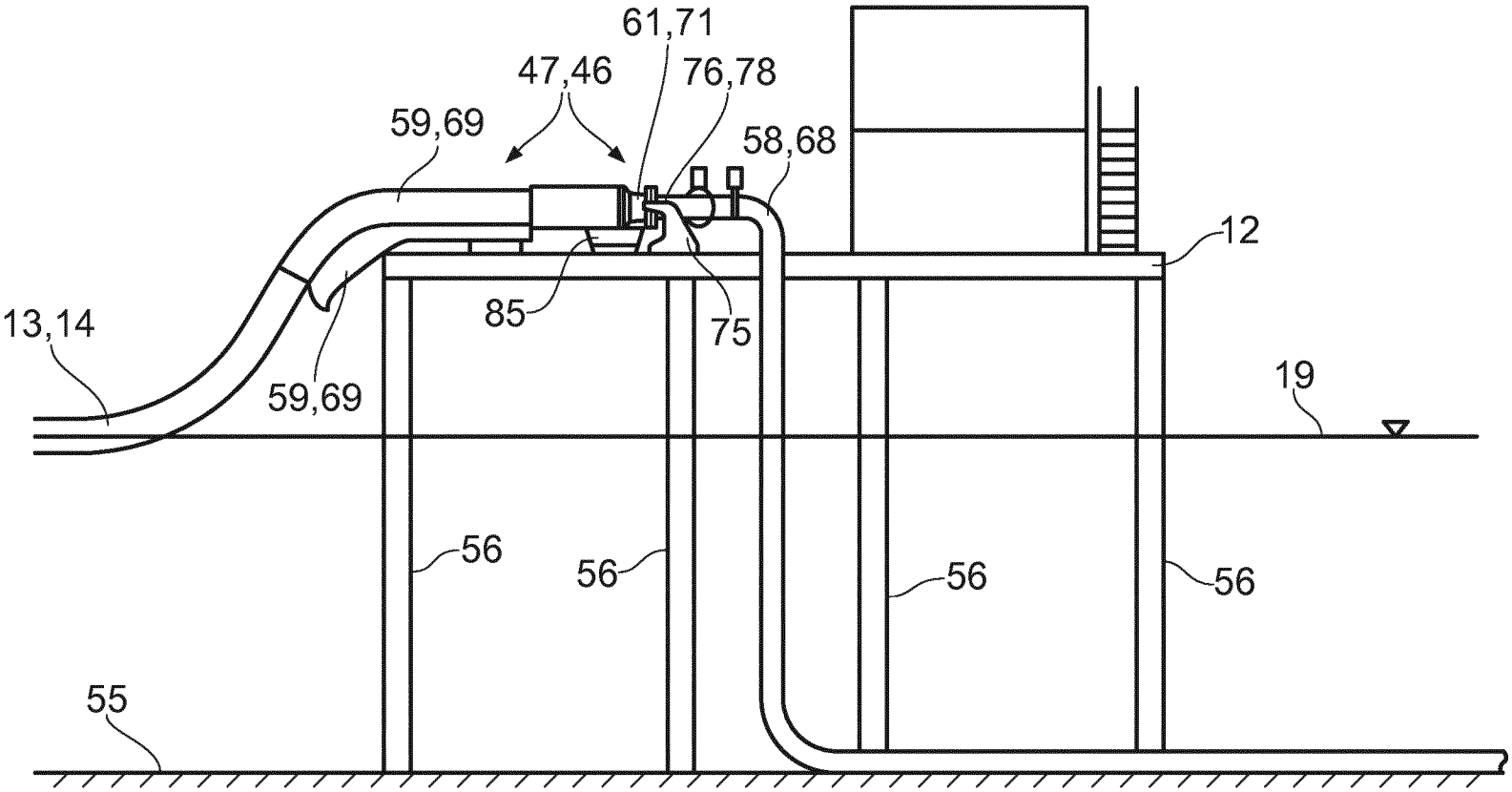
FIG. 9 shows a floating transfer pipe being connected to a pipe element of a process system on a support unit with legs that are attached to the seabed, where the transfer pipe is connected to the pipe element with a tie-in system as shown in more detail in FIGS. 1-8.
Figure 10:
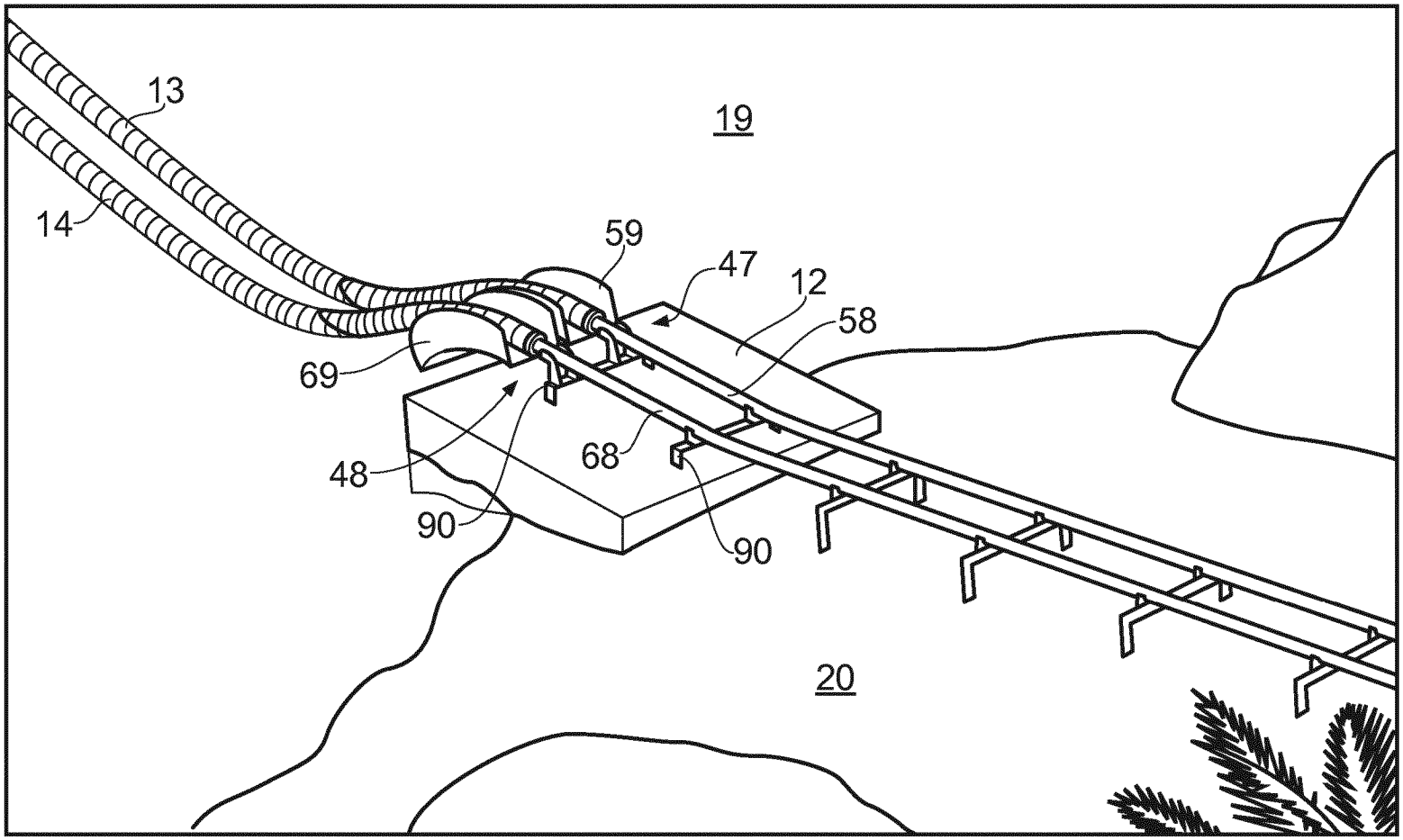
FIG. 10 shows two floating transfer pipes being connected to respective pipe elements of a process system on a support unit which arranged at least partly onshore, where the transfer pipes are connected to the respective pipe elements with a tie-in system as shown in more detail in FIGS. 1-8.

In FIGS. 9 and 10 there are shown two other possible configurations of the fluid transfer system 10.

In FIG. 9 a configuration of the present invention is illustrated where the support unit 12 comprises a number of piles 56 that are mounted in the seabed 55 as clearly shown in the figure. At least one transfer pipe 13, 14, preferably a floating transfer pipe, is connected to at least one pipe element 58, 68 in the same way as described in connection with FIGS. 1-8 above. The at least one transfer pipe 13, 14 is further tied in to the support unit 12 with at least one tie-in system 47, 48 as described in connection with FIGS. 1-8 above. The at least one pipe element 58, 68 is lead into the water 19 and further to a facility (not shown in the figure) for receiving or supplying a fluid through the at least one pipe element 58, 68.

In FIG. 10 a configuration of the present invention is illustrated where the support unit 12 is a simplified structure that comprises a support that is arranged in the transition zone between land and sea 19. As shown, the support unit 12 can be a simple concrete structure that is built directly on the shore 20 and/or seabed 55. At least one transfer pipe 13, 14, preferably a floating transfer pipe, is connected to at least one pipe element 58, 68 in the same way as described in connection with FIGS. 1-8 above. The at least one transfer pipe 13, 14 is further tied in to the support unit 12 with at least one tie-in system 47, 48 as described in connection with FIGS. 1-8 above. The at least one pipe element 58, 68 is lead onshore from the support unit 12 and further to a facility (not shown in the figure) for receiving or sending off a fluid through the at least one pipe element 58, 68.

Although through most of the description of the figures, the transfer pipe or pipes 13, 14 have been described as transporting a fluid, it should be kept in mind that a bulk material, such as a substance in powder form, can be transported through the transfer pipe or transfer pipes 13, 14 and the process system 15 on the support unit 12.

The invention has now been explained with reference to non-limiting examples of the invention. Although the present invention and its advantages have been described in detail, it should be understood that various changes, substitutions and alterations can be made to the embodiments disclosed herein. A person skilled in the art will therefore appreciate that modifications and changes may be made to this embodiment which will be within the scope of the invention as defined in the following claims.

The invention claimed is:

1. A fluid transfer system, comprising a process system and a support unit where the process system is arranged on the support unit, for transfer of a fluid between a floating facility and a receiving structure via the support unit, wherein the process system comprises:

a first pipe element for transport of fluid on the support unit, a second pipe element for transport of fluid on the support unit, a first cross over pipe that is fluidly connected to the first pipe element and the second pipe element, a second cross over pipe that is fluidly connected to the first pipe element and the second pipe element, a first valve device arranged in the first cross over pipe, a second valve device arranged in the second cross over pipe a first cargo valve device that is provided in the first pipe element, and a second cargo valve device that is provided in the second pipe element wherein the process system is movably supported on the support unit, and further wherein the fluid transfer system comprises at least one limit stop that limits movements of at least one of the first and second pipe elements of the process system relative to the support unit in at least one direction.

2. Fluid transfer system according to claim 1,
wherein the first cargo valve device is provided in the first pipe element between a first cross pipe connection, where the first cross over pipe is fluidly connected to the first pipe element, and a third cross pipe connection, where the second cross over pipe is fluidly connected to the first pipe element, and wherein the second cargo valve device is provided in the second pipe element between a second cross pipe connection, where the first cross over pipe is fluidly connected to the second pipe element, and a fourth cross pipe connection where the second cross over pipe is fluidly connected to the second pipe element.

3. Fluid transfer system according to claim 1,
wherein the first pipe element of the process system is adapted to be connected to a first transfer pipe and the second pipe element of the process system is adapted to be connected to a second transfer pipe.

4. Fluid transfer system according to claim 1,
wherein the first pipe element of the process system is connected to a first transfer pipe and the second pipe element of the process system is connected to a second transfer pipe.

5. Fluid transfer system according to claim 1,
wherein the process system comprises a first aerial hose that is fluidly connected to the first pipe element and a second aerial hose that is fluidly connected to the second pipe element, the first and second aerial hoses being adapted to be connected to the floating or non-floating facility.

6. Fluid transfer system according to claim 5,
wherein the first and second aerial hoses are fluidly connected to the first pipe element and the second pipe element with a first break away coupling and a second break away coupling respectively.

7. Fluid transfer system according to claim 1,
wherein the fluid transfer system comprises at least one process system support device that is securely mounted to the support unit and/or the process system, the at least one process system support device being adapted to allow the process system to move relative to the support unit in response to external forces acting on the process system.

8. Fluid transfer system according to claim 7,
wherein the at least one process system support device comprises a slide bearing.

9. Fluid transfer system according claim 1,
wherein the fluid transfer system comprises:
- a first spool piece that in one end is connected to the first transfer pipe and in the other end is attached to the first pipe element,
- a second spool piece that in one end is connected to the second transfer pipe and in the other end is attached to the second pipe element,
- a first chute device that is attached to the support unit, the first transfer pipe being accommodated in the first chute device such that the first chute device supports the first transfer pipe and takes up vertical and transverse forces acting on the first transfer pipe,
- a second chute device that is securely attached to the support unit, the second transfer pipe being accommodated in the second chute device such that the second chute device supports the second transfer pipe and takes up vertical and transverse forces acting on the second transfer pipe,
- a first tie-in device that is connected to a first spool piece tie-in member that is arranged on the first spool piece and to a first tie-in member arranged on a tie-in support that is securely attached to the support unit and a second tie-in device that is connected to a second spool piece tie-in member that is arranged on the first spool piece and to a second tie-in member arranged on the tie-in device, whereby the tension loads are transferred from the first transfer pipe to the support unit,
- a first tie-in device that is connected to a first spool piece tie-in member that is arranged on the second spool piece and to a first tie-in member arranged on a tie-in support that is securely attached to the support unit and a second tie-in device that is connected to a second spool piece tie-in member that is arranged on the second spool piece and to a second tie-in member arranged on the tie-in device, whereby the tension loads are transferred from the second transfer pipe to the support unit.

10. Fluid transfer system according to claim 9,
wherein the first pipe element of the process system is connected to the first transfer pipe with a first spool piece and the second pipe element of the process system is connected to a second transfer pipe with a second spool piece.

11. Fluid transfer system according to claim 1,
wherein a first emergency shut down valve is provided in the first pipe element and a second emergency shut down valve is provided in the second pipe element.

12. Fluid transfer system according to claim 11,
wherein the first emergency shut down valve is provided in the first pipe element between a first cross pipe connection where the first cross over pipe is fluidly connected to the first pipe element and a third cross pipe connection where the second cross over pipe is fluidly connected to the first pipe element, and wherein the second emergency shut down valve is provided in the second pipe element between a second cross pipe connection where the first cross over pipe is fluidly connected to the second pipe element and a fourth cross pipe connection where the second cross over pipe is fluidly connected to the second pipe element.

13. Fluid transfer system according to claim 11,
wherein the process system comprises a vent mast that is fluidly connected to the first pipe element between the first cargo valve device and the first emergency shut down valve, and to the second pipe element between the second cargo valve device and the second emergency shut down valve.

* * * * *